United States Patent [19]

Oishi et al.

[11] 4,052,214

[45] Oct. 4, 1977

[54] COLOR DIFFUSION TRANSFER PHOTOGRAPHIC LIGHT-SENSITIVE MATERIAL FOR FORMING BOTH POSITIVE TRANSFER DYE IMAGES AND NEGATIVE DYE IMAGES

[75] Inventors: Yasushi Oishi; Yoshinobu Yoshida, both of Minami-ashigara, Japan

[73] Assignee: Fuji Photo Film Co., Ltd., Minami-ashigara, Japan

[21] Appl. No.: 607,967

[22] Filed: Aug. 26, 1975

[30] Foreign Application Priority Data

Aug. 26, 1974 Japan ..... 49-97640

[51] Int. Cl.[2] ..... G03C 1/76; G03C 1/40; G03C 7/00; G03C 5/24

[52] U.S. Cl. ..... 96/74; 96/3; 96/29 D; 96/77

[58] Field of Search ..... 96/3, 29 D, 77, 74, 96/68, 69

[56] References Cited

U.S. PATENT DOCUMENTS

| | | | |
|---|---|---|---|
| 3,148,062 | 9/1964 | Whitmore et al. | 96/3 |
| 3,227,551 | 1/1966 | Barr et al. | 96/3 |
| 3,227,554 | 1/1966 | Barr et al. | 96/3 |
| 3,364,022 | 1/1968 | Barr | 96/77 |
| 3,443,940 | 5/1969 | Bloom et al. | 96/77 |
| 3,635,707 | 1/1972 | Cole | 97/3 |
| 3,647,436 | 3/1972 | Bosh | 96/77 |
| 3,736,136 | 5/1973 | Danhauser et al. | 96/77 |

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

A color photographic light-sensitive material, which comprises a transparent support having thereon at least one emulsion layer unit containing the following three layers and capable of simultaneously providing, as a result of exposure and development, both a diffusible dye with a positive image distribution and a non-diffusible dye with a negative image distribution:

1. a hydrophilic colloidal layer containing a ballasted coupler capable of reacting with an oxidation product of an aromatic primary amine color developing agent to form a diffusible dye, and a spontaneously developable, slightly soluble silver salt dispersion,
2. a first negative type light-sensitive silver halide emulsion layer provided adjacent the colloidal layer (1) and containing a ballasted compound capable of reacting with an oxidation product of an aromatic primary amine color developing agent to release a diffusible development inhibitor inhibiting the development of the silver salt in the above-described colloidal layer (1), and
3. a second negative type light-sensitive silver halide emulsion layer containing a ballasted coupler capable of reacting with an oxidation product of an aromatic primary amine color developing agent to release a non-diffusible dye and providing a dye image having a negative gradation suitable as an original for color prints in cooperation with the silver halide emulsion layer (2), and a diffusion transfer color photographic film unit including a light-sensitive element comprising the above color photographic light-sensitive material; an image receiving element; and a processing solution element.

70 Claims, 6 Drawing Figures

FIG. 1
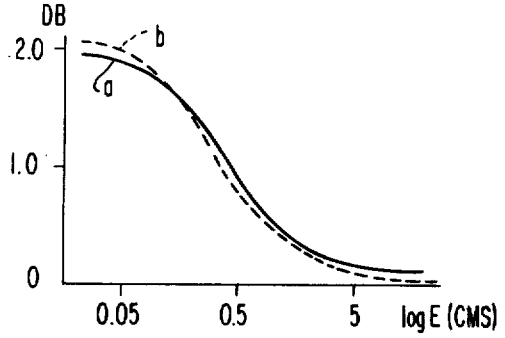
FIG. 3
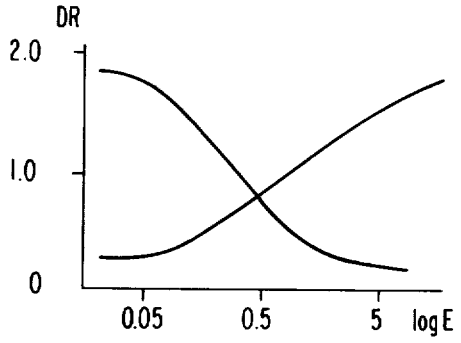
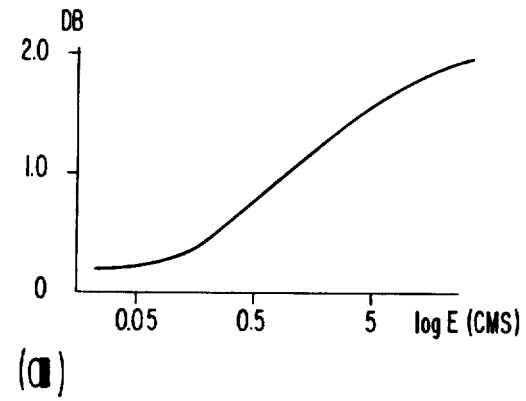
(a)
FIG. 4
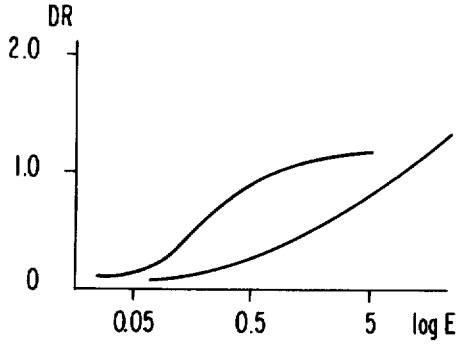
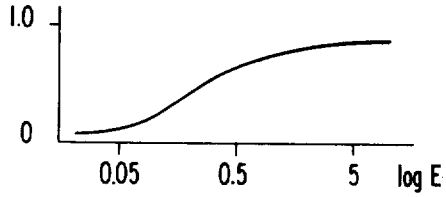
(b)
FIG. 2
FIG. 5
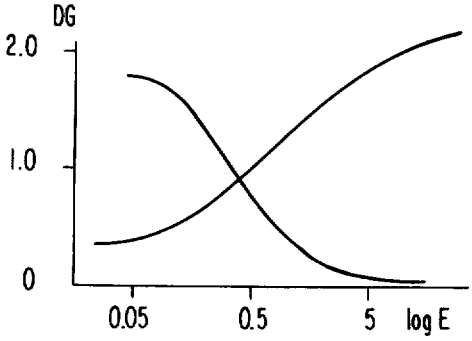
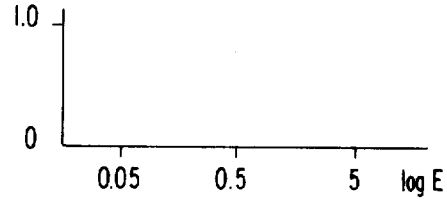
(c)

COLOR DIFFUSION TRANSFER PHOTOGRAPHIC LIGHT-SENSITIVE MATERIAL FOR FORMING BOTH POSITIVE TRANSFER DYE IMAGES AND NEGATIVE DYE IMAGES

BACKGROUND OF THE INVENTION

1. Field of the Invention.

The present invention relates to a color photographic light-sensitive material and, more particularly, to a diffusion transfer color photographic material which provides simultaneously both a positive image and a negative fixed image having improved gradation.

2. Description of the Prior Art.

The so-called diffusion transfer color photography, in which a silver halide emulsion layer is used as a light-sensitive element and diffusible dyes formed as a result of the imagewise exposure and development are allowed to diffuse in an imagewise manner into another layer and are fixed there to form dye images, is well known. In this photographic process, since transferred dye images are formed in a layer different from the emulsion layer, it is not necessary to remove remaining emulsion particles and silver deposited by fixing, bleaching or like steps. Therefore, dye images can be obtained using only one processing.

Known systems of providing diffusion transferred dye images include a process of using a compound capable of reacting with an oxidation product of an aromatic primary amino developing agent to release a diffusible dye, and a number of processes for obtaining diffusible dyes with a positive distribution using a negative type light-sensitive silver halide emulsion. Furthermore, the transfer of dye images from a light-sensitive element comprising a support having superposed thereon a plurality of emulsion layers having associated therewith diffusible dye-providing materials for subtractive color reproduction to a common image-receiving layer is also known.

However, the conventionally known diffusion transfer color photographic materials are so designed that only one dye image (positive type in many cases) is formed by transfer and the processed light-sensitive element is not further used or is thrown away.

In this respect, Japanese patent application No. 61122/73 discloses a film unit which contains a unit comprising:

1. a negative type silver halide emulsion layer containing a non-diffusible coupler capable of reacting with an oxidation product of an aromatic primary amino developing agent to provide a non-diffusible dye and a diffusible development inhibitor, and 2. an adjacent light-insensitive layer containing a diffusion-resistant coupler capable of reacting with an oxidation product of an aromatic primary amino developing agent to provide a diffusible dye. The above-described unit has enabled one diffusion transferred positive image and one negative image comprising non-diffusible dye which can be used as a color print original to be obtained.

SUMMARY OF THE INVENTION

The present invention relates to an improvement in the fundamental principle described in Japanese patent application No. 61122/73. With the film unit disclosed in Japanese patent application No. 61122/73, difficulties occur in that, under some development conditions, the gradation of a negative material suitable as an original for color printing is difficult to obtain due to the interlayer action of a development inhibitor released with a negative image distribution, and that color separation between units is not sufficient. Thus, it has been recognized that an improvement in these disadvantages would markedly increase the usefulness of the original diffusion transfer film unit.

Accordingly, an object of the present invention is to provide a film unit which can provide, immediately after photographing, a positive, transferred color image and a color negative image having improved gradation and improved color separation properties.

Another object of the present invention is to provide one transferred positive print and, if desired, to be able to print a plurality of secondary extra copies of color prints having improved image quality.

A further object of the present invention is to provide a photographic film unit which provides one transferred positive print and which enables, if desired, secondary copies of the print freely permitting reduction, enlargement or trimming to be prepared.

Still a further object of the present invention is to provide a diffusion transfer color photographic film unit which also provides a color negative facilitating reprinting of secondary copies.

Still a further object of the present invention is to provide a diffusion transfer color photographic film which also provides a color negative which has a wide exposure latitude sufficient to facilitate correction of an excess in or deficiency, in exposure upon reprinting secondary copies.

Still a further object of the present invention is to provide a film unit suitable for a photographic system, which produces less waste in image formation, less waste to be discarded and enables silver to be recovered in high yield.

Still a further object of the present invention is to provide a film unit which serves to establish a total photographic system combining a conventional ordinary color photographic system, commercially and technically well established, with a diffusion transfer color photographic system having the advantage of instant photography, thus taking the best of the advantages of both systems.

These and other objects of the present invention will become apparent from the following detailed description and Examples of the present invention.

The above-described objects of the present invention are attained with a color photographic light-sensitive material and a film unit having the following structure. That is, the color photographic light-sensitive material of the present invention comprises a transparent support having thereon at least one emulsion layer unit containing the following three layers and capable of simultaneously providing, as a result of exposure and development, both a diffusible dye with a positive image distribution and a non-diffusible dye with a negative image distribution:

1. a hydrophilic colloidal layer containing a ballasted coupler capable of reacting with an oxidation product of an aromatic primary amine color developeing agent to form a diffusible dye, and a spontaneously developable slightly soluble silver salt dispersion, 2. a first negative type silver halide light-sensitive emulsion layer provided adjacent hydrophilic colloidal layer (1) and containing a ballasted compound capable of reacting with an oxidation product of an aromatic primary amine color developing agent to release a diffusible development inhibitor inhibiting the development of the silver salt in the above-described hydrophilic colloidal layer (1), and 3. a second negative type light-sensitive silver halide emulsion layer containing a ballasted coupler capable of reacting with an oxidation product of an aromatic primary amine color developing agent to release a non-diffusible dye and providing a dye image having a negative gradation suitable as an original for color prints in cooperation with the above-described emulsion layer (2).

BRIEF DESCRIPTION OF THE DRAWINGS

FIG. 1 shows the characteristic curves of transferred positive images obtained with the film unit of the present invention and a control film unit.

FIG. 2 shows the characteristic curves of yellow negative images obtained with the film unit of the present invention and a control film unit.

FIG. 3 shows the characteristic curves of transferred cyan positive images and cyan negative images obtained with the film unit of the present invention and a control film unit.

FIG. 4 shows the characteristic curves of cyan negative images of individual light-sensitive layers of each element constituting the light-sensitive material of the present invention.

FIG. 5 shows the characteristic curves of a transferred magenta positive image and a negative image obtained with the film unit of the present invention.

DETAILED DESCRIPTION OF THE INVENTION

Figure 6:
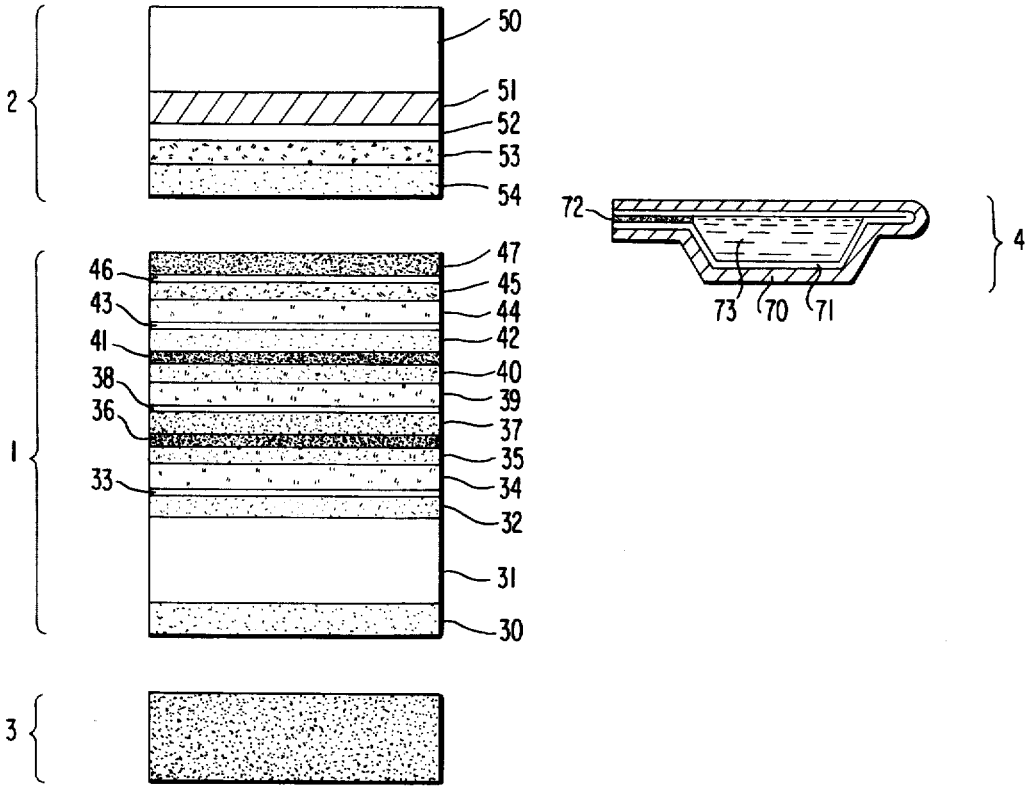
FIG. 6 schematically shows a cross sectional view of the main elements constituting a film unit of the present invention.

The color photographic light-sensitive material of the present invention can be advantageously used as a diffusion transfer color photographic film unit by combining the color photographic light-sensitive material with an image-receiving element having a colloidal layer containing a mordant to receive diffusible dyes formed as a result of exposure and development, and an alkaline processing solution element to be spread in a layer form on the light-sensitive material to cause development, formation of dyes and transfer of diffusible dyes.

A typical course of the use of the light-sensitive material and diffusion transfer film unit in accordance with the present invention is as follows.

1. The light-sensitive material is imagewise exposed in a camera either directly from the opposite side to the support side or through the transparent support from the support side.

2. A processing solution element is spread on a coated photographic layer of the exposed light-sensitive material in a layer form. If desired, the processing solution element can be retained in a rupturable container, and which is ruptured, after exposure, by the action of pressure-applying members contained in a camera to apply the processing solution to the photographic layer of the light-sensitive material.

3. Each negative type light-sensitive silver halide emulsion of each unit is developed in accordance with the amount of exposure by the action of an alkali, an aromatic primary amine developing agent and other effective components. At this point, the development is a negative type development. That is, the amount of silver deposited increases in proportion to the amount of exposure. With the reduction of the exposed light-sensitive silver halide, the developing agent is oxidized and reacts, in the first emulsion layer, with a development inhibitor-releasing compound to release a development inhibitor in a negative image distribution and reacts, in the second emulsion layer, with a diffusion-resistant coupler to form a non-diffusible dye with also a similar negative image distribution.

4. A development inhibitor released from the first light-sensitive layer of each unit diffuses, at least in part, to an adjacent light-insensitive colloidal layer containing a spontaneously developable silver salt to inhibit the reduction of the silver salt in proportion to the amount of the development inhibitor.

Thus, in the light-insensitive layer, the silver salt is reduced with a positive image distribution, which is followed by the reaction between a ballasted coupler in the layer and an oxidation product of an aromatic primary amino developing agent to release a diffusible dye in a positive image distribution. The diffusible dye released from each unit diffuses through the various layers of the film unit to reach an image-receiving element and is fixed there, thus forming a first positive dye image.

5. When transfer of the diffusible dyes reaches a desired level, the development in the light-sensitive material is discontinued due to the exhaustion of processing components, or by means of a timing mechanism for stopping development (e.g., a release of a development-stopping agent, a supply of a developing agent scavenger, etc.) contained in the film unit.

6. The portion comprising a transparent support having a light-sensitive layer thereon is separated, sooner or later, from the other portion of the film unit depending upon the purpose of the end use of the film unit. At this point, the primary positive image formed in the image-receiving element is advantageously used as such. The light-sensitive layer portion is then subjected to after-processings including bleaching (oxidation of silver deposited), fixation (solubilization and removal of the remaining silver salt) and removal of the remaining diffusible dyes. Thus, the light-sensitive layer portion ultimately contains a color negative image comprising non-diffusible dyes. At this point, the color negative images formed in the first and second light-sensitive emulsion layers of each light-sensitive unit have in cooperation a negative gradation suitable as an original for color printing.

7. A secondary positive dye image, which enables, if desired, color correction, correction of the amount of exposure, enlargement, printing with a reduced size or printing with trimming to be accomplished, or enables a plurality of copies to be printed, is obtained by using as an original transparency the color negative film obtained from the after-processing of the light-sensitive element and optically printing the color negative film obtained on a positive material such as a color positive film or a color paper, followed by development processing.

Various terms as used in the specification as to description of the present invention are explained below.

With respect to diffusibility, when a sufficient quantity of a material, contained in each layer of the film unit or in the layer formed upon processing, to cause photographic effects diffuses into other layer, this substance is referred to as being diffusible, whereas a material which diffuses in an insufficient quantity to substantially cause photographic effects, the material is referred to as being non-diffusible. Materials which are rendered non-diffusible through means such as association or polymerization are sometimes referred to as being diffusion-resistant or ballasted. These terms are used herein as they are generally used in the color photographic field. The degree or extent of diffusion is appropriately determined taking as a standard the conditions of the photographic layers into which the processing composition has permeated. In greater detail, with respect to the film unit of the present invention, the extent of diffusion is appropriately determined based on the degree of diffusion in a hydrophilic colloidal layer such as a gelatin layer containing an alkaline aqueous solution of a pH of about 10.

With respect to color sensitivity and the absorption of dyes, these terms are employed in the same manner as widely used in subtractive color reproduction photography. That is, a light-sensitive material having a blue-sensitive unit wherein a blue-sensitive silver halide emulsion is associated with both a yellow non-diffusible dye-providing coupler and a yellow diffusible dye-providing coupler, a green-sensitive unit wherein a green-sensitive silver halide emulsion is associated with both a magenta non-diffusible dye-providing coupler and a magenta diffusible dye-providing coupler, and a red-sensitive unit wherein a red-sensitive silver halide emulsion is associated with both a cyan non-diffusible dye-providing coupler and a cyan diffusible dye-providing coupler, is the most useful for the present invention.

The present invention can also be applied to a system which contains auxiliary color-correcting means in addition to the three main colors.

The coupler which is contained in a light-insensitive layer and which provides diffusible dye is said to be "colorless" in such a sense and extent that the dye possesses no absorption in the light-sensitive wavelength region of the unit containing the dye, this absorption greatly reducing the sensitivity of the light-sensitive emulsion, and that the processed light-sensitive element does not possess an absorption which seriously deteriorates the property of the element as a negative original for color printing.

The term "spontaneously developable silver salt" means a silver salt which can be reduced to a degree necessary for forming images with a developing agent under given development conditions without the action of light. An additional material may also be present to render the silver salt spontaneously developable.

The hydrophilic colloidal layer containing the spontaneously developable silver salt and the first light-sensitive silver halide emulsion are adjacent each other in such manner that they are not separated from each other by a layer which substantially inhibits the action of a development inhibitor to be released from the first emulsion layer on the hydrophilic colloidal layer.

A dispersion of spontaneously developable and slightly water-soluble silver salt to be used in the present invention can be prepared by dispersing in a hydrophilic colloid a silver salt having a solubility of not more than about 0.005 part, preferably not more than about 0.001 part, in 1 part of water with a particle size of about 0.1 to 10 $\mu$, and can be spontaneously reduced through chemical or physical development in the presence of an aromatic primary amine developing agent and alkali. Suitable silver salts include silver halides (e.g., silver chloride, silver bromide, silver chlorobromide, silver chloroiodide, silver bromoiodide, silver chlorobromoiodide, etc.), silver thiocyanate, mixed crystals of silver thiocyanate and silver bromide, silver orthophosphate, silver pyrophosphate, silver carbonate, silver iodate, silver citrate, mixed crystals of silver citrate and silver chloride, silver oxalate, silver tartrate, silver salicylate, etc. The dispersion of these silver salts can be prepared using a precipitation process similar to that described in P. Grafkides, *Chimie Photographique*, 2nd Ed., Chapters 18 - 20, Photocinema, Paul Montel, Paris (1957), and Mano & Nakamura, *Journal of Japanese Photographic Association*, Vol. 16, pp. 59 - 65 (1954). For the optical properties of the photographic layer and effective action of a development inhibitor, these silver salts preferably possess a mean grain size of from about 0.2 $\mu$ to about 2 $\mu$. Some of the dispersions of these silver salts can be spontaneously developed as such under certain development conditions. However, with other dispersions, an activating processing is usefully applied so as to impart a desired development rate thereto. One useful process for activation so that they are spontaneously developable is to directly add nuclei having a catalytic action in an amount of about $5 \times 10^{-4}$ to $5 \times 10^{-2}$ mol per mol of the silver salts employed. Examples of catalytic nuclei include fine colloidal metals such as silver, gold, palladium, platinum, etc., and fine colloidal sulfides such as copper sulfide, silver sulfide, gold sulfide, cadmium sulfide, zinc sulfide, etc. Examples of silver salts particularly suitable for use in combination with these formed nuclei are silver chloride, silver chlorobromide, silver chlorobromoiodide, silver thiocyanate, etc., as described in Japanese Patent Publication No. 49611/72. In this case, development is advantageously conducted in the presence of a silver complexing agent such as sodium thiosulfate or uracil. Another process for activation to render them spontaneously developable is to form, through chemical means, nuclei functioning as developing nuclei (fog development nucleus) on the surface of the grains of above-described silver salt dispersion, particularly a silver halide dispersion. Nucleus-forming materials include those which form silver nuceli, gold nuclei, silver sulfide nuclei, or silver selenide nuclei upon reaction with a silver salt dispersion, such as a reducing agent, a mono- to tri-valent gold complex salt, active sulfur or a selenium compound. Particularly useful materials include hydrazine, phenylhydrazine, tetraethylenepentamine, stannus chloride, reducing saccharides, chloro complex salts of monovalent gold, thiosulfate complex salt of monovalent gold, thiocyanate complex salt of monovalent gold, sodium thiosulfate, trimethylthiourea, hydrolized products of skins, horns or hoof tissues of animals, and the like. The reaction conditions of these nucleus-forming substances with the silver salt dispersion is greatly dependent upon the properties of the silver salt and the nucleus-forming material. However, the reaction is advantageously conducted at a pH of from about 4 to about 10, a pAg of from about 5 to about 11, and at a temperature of from about 30° C to about 80° C. The most suitable reaction conditions for each individual case can be easily selected by those skilled in the art through routine testing. A further process for activation to achieve spontaneous developability is to use physical means such as irradiation with radiation (e.g., light, X-rays, gamma rays, beta rays, etc.), irradiation with ultrasonic waves, application of mechanical power, and the like. When these spontaneously developable silver salt are photosensitive, the photosensitivity is usefully reduced with a desensitizer described in Japanese Patent Application No. 12453/74 in order to obtain good reversal transer images. The spontaneously developable silver salt to be used in the present invention is advantageously processed previously with a development inhibitor such as a mercaptoazole (e.g., 1-mercapto-5-phenyltetrazole, etc.), 5-bromobenzotriazole, 5-nitrobenzimidazole, etc., in an amount such that fog development is not stopped but its rate is reduced, in order to enhance the effect of a development inhibitor supplied in an imagewise distribution from an adjacent light-sensitive emulsion layer and in order to improve the reversal properties.

The first negative type silver halide light-sensitive emulsion layer (2) of the emulsion layer unit of the present invention can contain a ballasted coupler capable of providing a non-diffusible dye having an absorption in a light-sensitive wavelength region, in addition to a development inhibitor-releasing compound. The second negative type silver halide light-sensitive emulsion layer (3) of the emulsion layer unit can contain a ballasted compound capable of releasing a development inhibitor with a negative image distribution as well as a ballasted coupler capable of providing a non-diffusible dye forming an original with a negative gradation for color printing in cooperation with a non-diffusible dye image provided by the above-described first emulsion layer. Here, the total amount of the both ballasted coupler capable of providing a non-diffusible dye and of releasing a development inhibitor employed in the first or the second negative type silver halide emulsion layer is about 0.025 to 0.25 mol, preferably about 0.05 to 0.125 mol per mol of the silver halide based on each emulsion layer unit thereof. In the first emulsion layer, the development inhibitor-releasing compound is in general present in an amount not less than about 20 mol %, preferably not less than 40 mol %, of the component(s) (i.e., the non-diffusible dye-forming couplers and the development inhibitor-releasing compounds) capable of coupling with an oxidation product of an aromatic primary amine developing agent, although this will vary depending upon the type of compound used, in order to cause a positive imagewise development in a hydrophilic colloidal layer containing a spontaneously developable and slightly soluble silver salt dispersion. In the second emulsion layer, the development inhibitor-releasing compound, in general, is effective if present in not more than about 20 mol %, preferably not more than 10 mol %, of the component(s) capable of coupling with an oxidation product of an aromatic primary amino developing agent, although this amount varies depending upon the type of the compound, and is present in order to provide a dye image adjusting the negative gradation for color printing. When the first emulsion layer is designed to provide a negative dye image, the second emulsion layer is preferably less sensitive than the first emulsion layer. The difference therebetween in the sensitivity is particularly preferably about 2/3 to 1/10. Because the photographic gradation of the first emulsion layer is limited by the conditions for providing a visually suitable positive image in the spontaneously developable layer and, in many cases, this emulsion layer does not independently provide a satisfactory gradation as a negative, as a result it is desirable to adjust the gradation of the high exposure region using the second emulsion layer.

The emulsion layer unit to be used in the present invention can have various forms. A hydrophilic colloidal layer containing a spontaneously developable silver salt dispersion is advantageously disposed on both sides of the first negative type light-sensitive silver halide emulsion layer containing a development inhibitor-releasing compound. Further, when only one spontaneously developable silver salt layer is disposed on the first negative type light-sensitive emulsion layer, the spontaneously developable silver salt layer is advantageously disposed adjacent the emulsion layer on the support side of the first light-sensitive emulsion layer. In these dispositions, the hydrophilic colloidal layer containing the spontaneously developable silver salt and the first light-sensitive silver halide emulsion layer are advantageously separated from each other by an interlayer comprising a hydrophilic colloid which has the action of controlling the migration of an oxidation product of a developing agent between these two layers without substantially inhibiting the action of the development inhibitor released from the first emulsion layer, on the hydrophilic colloidal layer. A hydrophilic colloidal layer containing a ballasted hydroquinone derivative as described in U.S. Pat. Nos. 2,360,290, 2,418,613, 2,675,314, 2,701,197, 2,704,713, 2,710,801, 2,728,659, 2,732,300, 2,735,765 and 2,816,028, and a colorless ballasted coupler as described in Japanese Patent Publication No. 61483/66, U.S. Pat. No. 3,770,431 and British Pat. No. 861,138 is useful as this interlayer.

With respect to the combination of the first light-sensitive emulsion layer containing a development inhibitor-releasing compound and an adjacent colloidal layer containing a spontaneously developable silver salt, the second negative type light-sensitive emulsion layer for adjusting the negative gradation is disposed on the outside in various arrangements. For example, from the standpoint of a first negative type silver halide light-sensitive emulsion layer, the second negative type silver halide light-sensitive emulsion layer can be positioned in various arrangements so long as the requirement that the second negative type silver halide light-sensitive emulsion layer is provided at a position further from the spontaneously developable silver dispersion layer is satisfied. An illustrative preferred example of the disposition of the emulsion layer unit is the following disposition: the second emulsion layer for adjusting gradation—the development inhibitor-releasing first emulsion layer—an interlayer—the spontaneously developable silver salt-containing colloidal layer→(support).

The light-sensitive material of the present invention advantageously possesses two or more emulsion layer units which differ in color sensitivity. The spontaneously developable silver salt layer of each emulsion layer unit contains a ballasted coupler capable of providing a diffusible dye with a selective absorption in the light-sensitive wavelength region of the respective unit, and the second light-sensitive emulsion layer and, in some cases, the first layer of the unit contains a ballasted coupler capable of providing a non-diffusible dye having a selective absorption in the light-sensitive wavelength region of the respective unit. Most preferably, the light-sensitive material has three emulsion layer units, a blue-sensitive emulsion layer unit, a green-sensitive emulsion layer unit and a red-sensitive emulsion layer unit, which are respectively associated with a yellow color-forming coupler, a magenta-forming coupler and a cyan-forming coupler. Furthermore, these units are preferably disposed in the order of a blue-sensitive emulsion unit, a green-sensitive emulsion unit and a red-sensitive emulsion unit, or of a blue-sensitive emulsion unit, a red-sensitive emulsion unit and a green-sensitive emulsion unit, from the side to be exposed. A yellow filter layer is preferably interposed between the blue-sensitive unit and other units. From the viewpoint of color separation, these emulsion layer units are preferably separated from each other by a spacer layer containing a component capable of capturing a diffusible development inhibitor released from the light-sensitive silver halide emulsion layer. This spacer layer usefully contains the above-described component which controls the migration of an oxidation product of a developing agent and a color-filtering component for correcting the color sensitivity of the light-sensitive material, as well as the component capable of capturing the development inhibitor such as fine metal colloidal particles (e.g., Carey-Lea type silver sol. etc.) and silver sal particles having a low sensitivity and a low tendency toward being spontaneously developed such as a Lipmann type silver halide emulsion having a high iodide content.

Suitable amount of the silver salts (or silver halides) emmployed in each emulsion layer unit of the spontaneously developable silver salt layer, the first negative type light-sensitive silver halide emulsion layer and the second negative type light-sensitive silver halide emulsion layer ranges from about 0.1 to 2.5 g, preferably from about 0.25 to 1.25 g, calculated as Ag, per g of binder employed therewith.

The light-sensitive material of the present invention can be employed in various types of diffusion transfer color photographic film units. The main elements constituting a film unit include an image-recieving element, a processing solution element, a neutralizing element as well as a light-sensitive element. The light-sensitive element of the present invention can be combined with these film unit elements in various embodiments provided that a positive image comprising a diffusible dye and a negative image comprising a non-diffusible dye are easily obtained ultimately as separate forms. In one preferred embodiment, the emulsion layer units of the present invention are coated on a support which is temporarily light-intercepting, to form a light-sensitive material. After imagewise exposure from the side opposite to the support side, the light-sensitive material is brought into face-to-face contact with an image-receiving layer comprising a light-intercepting support having thereon, in sequence, a light-reflecting layer and a dye image-receiving layer and then passed as a film unit having a rupturable container retaining an alkaline processing solution at the leading edge thereof in the direction of travel toward the pressure applying means. As a result of the application of pressure, the processing solution is spread in a layer form between the light-sensitive material and the image-receiving layer to cause development, formation and transfer of dye images. After the substantial completion of the formation of a positive transferred image and a negative fixed image, the image-receiving layer is delaminated. Then, the light-sensitive layer is subjected to a silver-removing processing as described in Japanese Patent Application No. 105235/73 and, at the same time, the light-intercepting property of the support and the adhered processing solution layer are removed to provide a negative original for printing.

Another diffusion transfer film unit suitable for practicing the present invention is a film unit as disclosed in Japanese Patent Application No. 63157/73 (corresponding to U.S. patent application Ser. No. 476,241, filed June 4, 1974). This film unit comprises (1) a light-sensitive material comprising a transparent support having thereon, in sequence, one or more emulsion layer units and a removable light-intercepting, processing solution-permeable layer, and (2) an envelope-shaped composite comprising an image-receiving element comprising a transparent support having thereon a dye image-receiving layer and a light-intercepting sheet, which are bound together at the edges thereof, and having an opening for inserting the light-sensitive material. A rupturable container retaining an alkaline processing solution is advantageously fixed at the leading edge of the composite. With this film unit, the light-sensitive material is imagewise exposed from the support side. The exposed light-sensitive material is inserted through an opening into the composite in such manner that the emulsion layer of the light-sensitive material comes into a face-to-face contact with the image-receiving layer of the image-receiving element. Then, the processing solution is spread in a layer form between these layers to cause development, formation and transfer of dye images. The image-receiving element and the light-sensitive material are separated from each other in the manner as described above, and the light-sensitive material is subjected to a silver-removing processing and the processing solution-permeable light-intercepting layer is removed to obtain a positive color transferred image and a negative fixed image for use in color printing. The present invention can be also applied to a film unit as described in British Pat. No. 1,330,524, wherein these layers are coated on a support, in addition to the film units wherein the emulsion layer and the dye image-receiving layer are coated on different supports, by subjecting the unit to an appropriate layer delamination procedure and a layer-fixing procedure.

The diffusion-resistant couplers which can be used in the present invention to provide non-diffusible dyes are compounds which contain both a coupler nucleus residue capable of reacting with an oxidation product of an aromatic primary amino color developing agent to form a dye structure and a hydrophobic residue having 8 or more carbon atoms. Examples of coupler nucleus residues which can be used are those described in C. E. K. Mees & T. H. James, *The Theory of the Photographic Process*, 3rd Ed., pp. 383 - 394, Macmillian, New York (1966), and Pelz, *Farbkuppler*, Agfa Mitteilungen (Leverkusen), III, pp. 111 - 175 Springer Verlag (1961), as well as a phenol residue, an aniline residue and an open-chain or cyclic active methylene group-containing residue. The hydrophobic residue functions to reduce the solubility of the coupler in an aqueous medium or reduce the diffusibility thereof in photographic layers by increasing the cohesive force between the coupler molecules or between the coupler molecule and an oily material to thereby increase the intermolecular association, or the like.

Useful hydrophobic residues include a straight or branched chain alkyl group such as a n-octyl group, a 2-ethylhexyl group, a t-octyl group, an n-nonyl group, a triisopropyl group, a decyl group, an n-dodecyl group, a 1,1-dimethylhexadecyl group, a stearyl group, etc.; a cycloalkyl group such as a 2,4-di-n-amylcyclohexyl group, etc.; an alkenyl group such as an oleyl group, etc.; an aryl group such as a terphenyl group, etc.; a haloalkyl group such as an 8,9-dichloroheptadecyl group, a perfluorooctyl group, etc.; an alkoxyalkyl group or an alkylthioalkyl group such as a 3-n-dodecyloxypropyl group, a 2-n-dodecylthiopropyl group, etc.; an alkylaryl group such as a 4-t-amylphenyl group, a p-n-octylphenyl group, a 2,4-di-t-butylphenyl group, a 2,4-di-t-amylphenyl group, a 3-n-pentadecylphenyl group, etc.; an alkoxyaryl group such as a 3-n-hexyloxyphenyl group, a 3-n-dodecyloxyphenyl group, a 2-n-dodecyloxyphenyl group, etc.; and the like. These hydrophobic residues can be connected to the coupler nucleus either directly or through a divalent linking group such as an alkylene group, an arylene group, an oxyalkyl group (-O-alkylene- group (e.g., an oxyethylene group, an α-oxyethyl group, an α-oxypropyl group, a γ-oxypropyl group, an ω-oxybutyl group, etc.)), an amido group, a carbamyl group, a sulfonamido group, a sulfamyl group, a ureido group, an imido group (e.g., 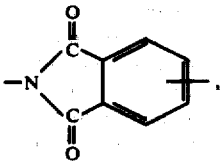 ,

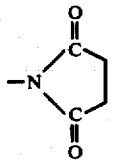 , etc.), a carbonyl group, an oxycarbonyl group, a sulfonyl group, a sulfonyloxy group, an oxysulfonyl group, or the like. With couplers which do not contain water-solubilizing groups such as a sulfo group or a carboxy group, the hydrophobic group can be present in a substitutent positioned at the coupling site which is to be eliminated by the oxidation product of an aromatic primary amino color developing agent. The ballasted couplers to be used in the present invention can contain a water-solubilizing group such as a sulfo group, a carboxy group, a sulfonamido group, etc. In the so-called Fischer type couplers having these water-solubilizing groups, the hydrophobic residues preferably contain 12 to 32 carbon atoms, whereas in the so-called oleophilic protect-type couplers which do not contain these water-solubilizing groups, the hydrophobic residues preferably contain 8 to 32 carbon atoms.

Specific examples of ballasting groups comprising the hydrophobic groups and linkage groups particularly suitable for the diffusion-resistant couplers to be used in the present invention are: a fatty acid amido group such as an n-lauroylamido group, a stearoylamido group, an oleoylamido group, etc.; a carbamyl group substituted with an alkyl or alkenyl group, such as an N-laurylcarbamyl group, an N-methyl-N-stearylcarbamyl group, an oleylcarbamyl group, etc.; substituted aliphatic amido groups described in U.S. Pat. Nos. 3,337,344 and 3,418,129; an α-(2,4-t-amylphenoxy)acetamido group described in U.S. Pat. Nos. 2,600,788; an α-(2,4-di-sec-amylphenoxy)acetamido group described in British Pat. No. 1,149,514; an α- or γ-(3-pentadecylphenoxyl)-butyramido group described in U.S. Pat. No. 2,908,573; aliphatic amido groups substituted with an alkylaryloxy group, such as an α-dimethyl-α-(3-pentadecylphenoxy)acetamido group; aliphatic amido groups substituted with a water-solubilizing group, such as a 1-octadecenylsuccinmonoamido group, an α-sulfostearoylamido group, etc.; alkoxy groups such as an octadecyloxy group, etc.; ester groups such as a cetyloxycarbonyl group illustrated in U.S. Pat. Nos. 3,409,439 and 3,551,155; sulfamyl groups such as an N,N-dioctylsulfamyl group, etc.; and the like.

An α-acylacetamido residue and, particularly preferably, an α-acylacetanilido residue are useful as the nucleus of the coupler to be used in the present invention providing a yellow dye. These residues are connected to the above-described ballasting groups containing the hydrophobic residue in the acylamido (anilido) group and in the eliminatable residues at the coupling position. The above-described coupler nuclei can further be substituted with substituents such as a halogen atom, an alkyl group, an alkoxy group, an aryloxy group, a carboxy group, a sulfo group, an alkoxycarbonyl group, a sulfamyl group, an acylamido group, a sulfonamido group, an amino group, a nitro group, a cyano group, etc.

The ballasted couplers which can be advantageously used in the present invention providing non-diffusible yellow dyes can be selected from those conventionally known non-diffusible yellow dyes described in the Mees & James, supra, and Pelz, supra. α-Benzoylacetamide couplers containing a water-solubilizing group, as described in BIOS 1901, FIAT 943 and Japanese Patent Publication No. 6030/65; oleophilic α-benzoylacetamide couplers described in U.S. Pat. Nos. 2,407,210, 2,875,057, 3,409,439, 3,551,155, 3,551,156, 3,649,276, 3,685,995, British Pat. No. 1,286,441; α-pivaloylacetamide couplers described in U.S. Pat. No. 3,265,506; and the like are particularly useful for the practice of the present invention. Furthermore, one hydrogen atom located at the α-position of these α-acylacetamido groups can be replaced by a residue which can be eliminated as an anion, such as an arylthio group, a heterocyclic thio group, a halogen atom such as a fluorine atom described in U.S. Pat. 3,277,155, a thiocyano group described in U.S. Pat. No. 3,253,924, an acyloxy group described in U.S. Pat. No. 3,447,928, an aryloxy group described in U.S. Pat. No. 3,408,194, a sulfonyloxy group described in U.S. Pat. No. 3,415,652, a diacylamino group described in German Patent Application (OLS) 2,213,461, etc.

Typical preferred yellow couplers include the following yellow couplers.

Y-1: α-(4-Stearoylaminobenzyl)aceto-3,5-dicarboxyanilide

Y-2: α-[4-(α-Octadecenylsuccinmonoamido)benzoyl]-aceto-2-methoxy-5-carboxyanilide Y-3: α-(4-Octadecyloxybenzoyl)aceto-2-methoxy-5-sulfoanilide potassium salt Y-4: α-{3-[α-(2,4-Di-t-amylphenoxy)butyramido]benzoyl}-aceto-2-methoxy-anilide Y-5: α-(4-Methoxybenzoyl)aceto-2-chloro-5-[α-(2,4-di-t-amylphenoxy)butyramido]anilide Y-6: α-Benzoylaceto-2-chloro-5-dodecyloxycarbonylanilide Y-7: α-(2-Methylbenzoyl)aceto-2-chloro-5-tetradecyloxycarbonylanilide Y-8: α-(2-Methylbenzoyl)aceto-2-chloro-5-[N,N-bis-(2-ethylhexyl)sulfamyl]anilide Y-9: α-(4-Methoxybenzoyl)-α-(5,5-dimethyl-3-hydantoinyl)aceto-2-chloro-5-[α-(2,4-di-t-amylphenoxy)-butyramido]anilide Y-10: 60 -Pivaloyl-α-(4-carboxyphenoxy)aceto-2-chloro-5-[α-(3-pentadecylphenoxy)butyramido]anilide A 5-pyrazolone, residue, a pyrazolobenzimidazole residue, an indazolone residue and a 1-H-pyrazolo[3,2-C]-s-triazole residue are useful as nuclei for the couplers to be used in the present invention providing a magenta dye. In particular, a 1-aryl-5-pyrazolone is useful. In the present invention, 5-pyrazolone compounds containing a phenyl group in which the 1-position is unsubstituted or substituted with a halogen atom, an alkyl group, an alkoxy group, an aryloxy group, an acylamino group, a sulfonamido group, a carbamyl group, a sulfamyl group, an alkoxycarbonyl group, a cyano group, a nitro group, a carboxy group, a sulfo group, etc.; and 5-pyrazolone compounds in which the 3-position is substituted with an alkyl group, an alkoxy group, an aryloxy group, an amino group (e.g., an anilino group, etc.), an acylamino group, a sulfonamido group, a ureido group, a carbamyl group, an alkoxycarbonyl group, etc., can be used advantageously. Also, the corresponding acylated products of these 5-pyrazole compounds can be similarly used. The ballasting group containing a hydrophobic residue is advantageously present in the substituent in the 1- or 3-position of the 5-pyrazolone compounds.

The ballasted couplers which can be advantageously used in the present invention providing a non-diffusible magenta dye can be selected from those couplers described in Mees & James, supra, and Pelz, supra, or other literature references. 1-Phenyl-3-alkyl-5-pyrazolone couplers containing a water-solubilizing group, described in BIOS 1901, FIAT 943; 3-alkoxy-5-pyrazolone couplers described in U.S Pat. No. 2,439,098; 3-acylamino-5-pyrazolone couplers described in U.S. Pat. Nos. 2,600,788, 3,062,653, etc.; 3-amino-5-pyrazolone couplers described in British Pat. No. 956,261 and German patent application (OLS) No. 2,015,867; 3-arylureido-5-pyrazolone couplers described in U.S. Pat. No. 3,558,319; and the like are particularly useful in the practice of the present invention. Furthermore, one hydrogen atom of the active methylene group at the 4-position of the 5-pyrazolones can be replaced by a residue which can be eliminated with an oxidation product of the aromatic primary amine color developing agent, such as an arylazo group, a heterocyclic azo group; an arylthio group; a heterocyclic thio group; a thiocyano group as described in U.S. Pat. No. 3,253,924; an aryloxy group described in U.S. Pat. No. 3,419,391; an acyloxy group described in U.S. Pat. No. 3,311,476; a triazolyl group described in U.S. Pat. No. 3,415,652; an alkoxycarbonyloxy group; an arylidene or alkylidene group described in U.S. Pat. Nos. 2,706,683, 2,618,641, 3,468,666; and the like.

Typical preferred magenta-forming couplers include the following magenta-forming couplers.

M-1: 1-(3-Sulfo-4-phenoxyphenyl-3-heptadecyl-5-pyrazolone potassium salt

M-2: 1-Phenyl-3-(α-octadecenylsuccinmonoamido)-5-pyrazolone

M3: 1-Phenyl-3-{2-chloro-4-[β-N-(4-n-dodecylphenyl) acetylamino-β-carboxypropylamino]anilino}-5-pyrazolone M-4: 1-Phenyl-3-{3-[α-(2,4-di-sec-amylphenoxy)acetamido]-benzoylamido}-5-pyrazolone M-5: 1-(2,4,6-Trichlorphenyl)-3-{3-[α-(2,4-di-t-amylphenoxy)-butyramido]benzoylamido}-5-pyrazolone M-6: 1-Phenyl-3-{3-[α-(3-pentadecylphenoxy)butyrmido]phenyl}-uredio-5-pyrazolone M-7 :1-(2,6-Dichloro-4-methoxyphenyl)-3-{3-[α-(2,4-di-t-amylphenoxy)butyradmido]phenylureido}-5-pyrazolone M-8: 1-(2,4,6-Trichlorphenyl)-3-(2-chloro-5-myristoylamidoanilino)-5-pyrazolone M-9: 1-Phenyl-3-(2-chloro-5-tetradecyloxycarbonylanilino)-5-pyrazolone M-10: 1-(2,4,6-Trichlorophenyl)-3-{3-[α-(2,4-di-t-amylphenoxy)-acetamido]benzamido}-5-pyrazonyl(4)benzyl carbonate M-11: 1-(2,4,6-Trichlorophenyl)-3-(2,4-dichloroanilino)-4-(3-N-octadecylcarbamylphenylthio)-5-pyrazolone M-12: 1-(2,4,6-Trichlorophenyl)-3-{3-[α-(2,4-di-t-amylphenoxy)-acetamido]benzamido}-4-(4-methoxyphenylazo)-5-pyrazolone M-13: 1-(2,4,6-Trichlorophenyl)-3-(3,5-dimethoxycarbonylanilino)-4-(3-N-n-octadecylcarbamoylphenylthio)-5-pyrazolone M-14: 1-(2,4,6-Trichlorophenyl)-3-(2,4-dichloroanilino)-4-(4-N-methyl-N-n-octadecylsulfamoylphenylthio)-5-pyrazolone Compounds having a phenolic hydroxy group, in particular, phenolic compounds and α-naphtholic compounds are useful as nuclei for the couplers to be used in the present invention providing a cyan dye. Of these compounds, phenol derivatives substituted with an acylamino group at the o- or m-position and α-naphthol derivatives substituted with a carbamyl group at the 2-position are particularly useful. The ballasting group containing a hydrophobic residue is advantageously introduced into the coupler molecule as an acylamino group or as a carbamyl group. In these couplers, the p-position to the hydroxy group is the coupling position with an oxidized aromatic primary amino color developing agent. This coupling position can be either unsubstituted or substituted with a residue which can be eliminated by the oxidized developing agent. Other nucleus positions can be substituted with a halogen atom, an alkyl group, an alkoxy group, an aryloxy group, an acylamino group, a sulfonamido group, a carbamyl group, a sulfamyl group, an alkoxycarbonyl group, a cyano group, nitro group, a carboxy group, a sulfo group, a heterocyclic group (e.g., a 2-triazolyl group, a 2-imidazolyl group, etc.), and the like. The phenolic hydroxy group can be converted to an acylated form which can be hydrolyzable with an alkaline aqueous solution.

The ballasted couplers advantageously used in the present invention providing an non-diffusible cyan dye can be selected from those known compounds described in Mees & James, supra and Pelz, supra or other literature references. 2-Naphthamide couplers having a sulfo group, described in BIOS 1901, FIAT 943; acylaminophenol couplers described in U.S. Pat. Nos. 2,367,531, 2,369,929, 2,423,730; diacylaminophenol couplers described in U.S. Pat. Nos. 2,772,162 and 2,895,826; oil-soluble 2-naphthamide couplers described in U.S. Pat. Nos. 2,474,293; N,N-di-substituted naphthamide couplers described in U.S. Pat. No. 3,591,383; and the like are particularly useful in the practice of the present invention. These phenol derivatives can be substituted at the 4-position with a halogen atom such as a fluorine atom or a chlorine atom; an arylazo group; a heterocyclic azo group; an arylthio group; a heterocyclic thio group; an alkoxy group; an aryloxy group; a thiocyano group described in U.S. Pat. No. 3,253,924; an imido group described in U.S. Pat. No. 3,458,315; an aminomethyl group described in U.S. Pat. No. 3,419,390; a sulfonamido group as described in U.S. Pat. No. 3,785,825 or the like.

Typicl preferred cyan-forming couplers include the following couplers.

C-1: 1-Hydroxy-4-sulfo-N-octadecyl-2-naphthamide sodium salt

C-2: 1-Hydroxy-2'-(N-methyl-N-octadecylamino)-5'-sulfo-2-naphthanilide potassium salt C-3: 1-Hydroxy-N-[β-(α-sulfostearoylamido)ethyl]-2-naphthanilide sodium salt C-4: 1-Hydroxy-N-[γ-(2,4-di-t-amylphenoxy)propyl]-2-naphthamide C-5: 1-Hydroxy-4-chloro-N-dodecyl-2-naphthamide C-6: 1-Hydroxy-2'-chloro-5'-{[β-(2,4-di-t-amylphenoxy)ethoxy]carbonyl}-2-naphthanilide C-7: 4,6-Dichloro-5-methyl-2-[α-(2,4-di-t-amylphenoxy)butyramido]-phenol C-8: 2-Heptafluorobutyramido-5-[α-(2,4-di-t-amylphenoxy)-caproylamino]phenol C-9: 1-Hydroxy-4-(2-ethoxycarbonylazo)-N-(2-ethylhexyl)-2-naphthamide The couplers capable of providing diffusible dyes are employed in the spontaneously developable silver salt layer in an amount of about 0.1 to 1 mol, preferably about 0.17 to 0.5 mol per mol of the silver salts based on each emulsion unit thereof.

The couplers to be used in the present invention providing diffusible dyes are reactive, non-diffusible, substantially colorless compounds which are capable of coupling with an oxidized developing agent and which, as a result of the coupling reaction, can eliminate and release a dye soluble and diffusible in the development processing composition. These couplers are represented by the following general formula:

(Cp)-L-(B*l*)

wherein Cp represents a coupling reactive structure moiety in which the coupling position is substituted with the (B*l*)-L-residue and, when the coupler is to be used in combination with a developing agent which does not contain a water-solubilizing group such as a sulfo group or a carboxy group, the Cp residue contains a water-solubilizing group (e.g., a sulfo group, a carboxy group, a sulfonamido group, etc.) in at least one noncoupling position. Illustrative examples of the coupling reactive structure moieties which can be utilized as Cp include many functional groups which are known to undergo an oxidative coupling reaction with an aromatic primary amino color developing agent. Those described hereinbefore as the nuclei of the couplers providing non-diffusible dyes can be similarly used. For example, phenols, anilines, cyclic or open-chain active methylene compounds, and hydrazones can be used. Specific examples or particularly useful reactive structure moieties include those derived from acylamino-substituted phenols, 1-hydroxy-2-naphthoic acid amides, N,N-dialkylanilines, 1-aryl-5-pyrazolones (the 3-position being substituted with an alkyl group, an aryl group, an alkoxy group, an aryloxy group, an amino group, an acylamino group, a ureido group or a sulfonamido group), pyrazolobenzimidazoles, pyrazolotriazoles, α-cyanoacetophenones and α-acylacetanilides.

The connecting or linkage group L whose bond to the coupler structure moiety is to be split with an oxidized developing agent, can be an azo group, an azoxy group, a mercuryl group (—Hg—), an oxy group, a thio group, a dithio group, a triazolyl group, a diacylamino group, an acylsulfonamino group

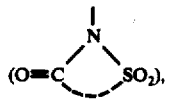

an acyloxy group, a sulfonyloxy group and an alkylidene group, Of these groups, an oxy group, a thio group, a dithio group, a diacylamino group, an acyloxy group, etc., which are to be eliminated as an anion, are useful since a large amount of diffusible dye is released. The coupling position of the coupling structure moiety of the phenol or naphthol is preferably substituted with a group to be connected through an oxy group, a thio group or a diacyloxy group. Also, the coupling position of the pyrazolone is preferably substituted with an azo group, a thio group or an acyloxy group, and the coupling position of the acylacetanilide is substituted with an oxy group, a thio group or a diacylamino group.

The hydrophobic residues present in the residues represented by B*l* are essentially the same as the above-described hydrophobic groups of the couplers providing non-diffusible dyes, and impart a cohesive force between the coupler molecules in an aqueous medium to render the molecules non-diffusible in a hydrophilic colloid constituting the light-sensitive material. Suitable hydrophobic residues which can be advantageously used include a substituted or unsubstituted alkyl group, an alkenyl group, an aralkyl group and an alkylaryl group, having 8 or more carbon atoms. For example, a lauryl group, a stearyl group, an oleyl group, a 3-n-pentadecylphenyl group, a 2,4-di-t-amylphenoxy group, and the like. These hydrophobic residues can be connected, directly or through a divalent bond such as an amido bond, a ureido bond, an ether bond, an ester bond or a sulfonamido bond, to a residue such as an aryl group or a heterocyclic group to form B*l*.

The water-solubilizing group present in the residue represented by Cp is an acidic group capable of being substantially dissociated in a processing composition or a precursor group which provides such an acidic group upon hydrolysis. In particular, acidic groups of having a pKa of not more than about 11 are useful. Examples of these groups are a sulfo group, a sulfuric ester group (—O—$SO_3H$), a carboxy group, a sulfonamido group, a diacylamino group, a cyanosulfonamino group, a phenolic hydroxy group, etc.

The bond L of the diffusible dye-releasing couplers to be used in the present invention upon reaction with an oxidized developing agent is cleaved to provide a soluble dye, which is an oxidative coupling reaction product between Cp and the developing agent, and a non-diffusible, substantially colorless, eliminated product derived from Bl-L. The resulting soluble dye diffuses into an image-receiving layer to form a dye image there.

Diffusible dye-providing couplers which can be used in the present invention with advantage include the following couplers. Yellow Diffusible Dye-Providing Couplers:

α-(4-Methoxybenzoyl)-α-(3-octadecylcarbamylphenylthio)-3,5-dicarboxyacetanilide

α-Pivaloyl-α-(3-octadecylcarbamylphenylthio)-4-sulfoacetanilide potassium salt

α-Pivaloyl-α-(4-octadecyloxycarbonylphenoxy)-3,5-dicarboxyacetanilide

Magenta Diffusible Dye-Providing Couplers:

1-(1-Methyl-phenyl)-3-(3,5-dicarboxyanilino)-4-(3-octadecylcarbamylphenylthio)-5-pyrazolone
1-Phenyl-3-(3,5-disulfobenzoylamino)-5-(2-hydroxy-4-n-pentadecylphenylazo)-5-pyrazolone
1-[4-(3,5-Dicarboxybenzamido)phenyl]-3-ethoxy-4-(3-octadecylcarbamylthio)-5-pyrazolone Cyan Diffusible Dye-Providing Couplers:

1-Hydroxy-4-(3-octadecylcarbamylphenylthio)-N-ethyl-3',5'-dicarboxy-2-naphthanilide
1-Hydroxy-4-(n-octadecylsuccinamido)-N-ethyl-3',5'-dicarboxy-2-naphthanilide
1-Hydroxy-4-n-hexadecyloxy-N-ethyl-N-3',5'-dicarboxy-2-naphthanilide Other specific examples of the diffusible dyereleasing couplers and the synthesis thereof are described in British Pat. Nos. 840,731, 904,364, 1,085,631, U.S. Pat. Nos. 3,476,563, 3,644,498, 3,419,371.

The development inhibitor-releasing compounds (the so-called DIR compounds) which can be used in the present invention are either (1) couplers or compounds which, upon coupling reaction with the oxidation product of an aromatic primary amine color developer, release a substituent at the reaction site, which substituent becomes a development inhibitor or (2) compounds which imagewise release a development inhibitor, for example, those compounds which, upon a subsequent reaction thereof in an oxidized state as a result of development, with hydroxide ion, sulfite ion or a like processing component, release a development inhibitor. The DIR couplers to be used in the present invention must contain in the molecule a hydophobic residue having 8 or more carbon atoms and must be ballasted. Those hydrophobic residues commonly used for ordinary ballasted couplers can be utilized. The eliminatable group in the DIR compounds can initially have a chemical structure with a development-inhibiting effect prior to elimination or can complete a chemical structure having a developmentinhibiting effect only after elimination. Useful development inhibitors include iodide ion, alkylmercaptans, arylmercaptans, heterocyclic mercaptans, triazoles, imidazoles, purine nucleus compounds, and the like. In particular, mercaptotriazoles, mercaptotetrazoles, mercaptopyrimidines, mercaptothiazines, mercaptoxazoles, mercaptoimidazoles, mercaptothiazoles and benzotriazoles exhibit great inhibiting effects. Illustrative specific examples include 4-nitrothiophenol, 2-ethoxycarbonylthiophenol, 1-phenyl-5-mercaptotetrazole, 2-mercaptobenzothiazole, 2-mercapto-4,6,6-trimethylpyrimidine, 5-bromobenzotriazole, etc. In order to avoid preventing development of the unexposed areas, these inhibitor structures are preferably introduced into the reaction site of the DIR compounds through a chemical bond which blocks the development-inhibiting center (e.g., an iodine-carbon bond, a thioether bond, a bond of carbon and an N-triazolyl group, etc.) rather than to introduce the inhibitor with a structure capable of exerting the developmentinhibiting action thereof into the DIR couplers. The DIR couplers to be used in the present invention with advantage can be either those couplers which provide a colored coupling product and a development inhibitor, as described in U.S. Pat. Nos. 3,148,062, 3,227,550, 3,227,551, 3,227,554, 3,617,291, or those couplers which provide a colorless coupling product and a development inhibitor, as described in U.S. Patent 3,632,345.

Typical preferable DIR couplers include the following couplers.

DIR Y-1: α-Pivaloyl-α-(1-phenyl-5-tetrazolylthio)-2-chloro-5-[γ-(2,4-di-t-amylphenoxy)butyramido]-acetanilide
DIR Y-2: α-a(4-Methoxybenzoly)-α-(1-phenyl-5-tetrazolythio)-2-chloro-5-[α-(2,4-di-t-amylphenoxy)-butyramido]-acetanilide
DIR Y-3: α-Benzoyl-α-(1-phenyl-5-tetrazolythio)aceto-2-methoxy-5-n-tetradecyloxycarbonylanilde
DIR Y-4: α-(p-n-Octadecyloxybenzoyl)-α-(5- or 6-bromobenzo-1-benzotriazolyl)aceto-2-methoxyanilide
DIR M-1: 1-{4-[α-(2,4-Di-t-amylphenoxy)butyramido]-phenyl}-3-(1-piperidino)-4-(1-phenyl-5-tetrazolythio)-5-pyrazolone
DIR M-2: 4-(Benzotriazolyl)-1-(2,4,6-trichlorophenyl)-3-}3-[α-(2,4-di-t-amylphenoxy)acetamido]benzamido}-5-pyrazolone
DIR M-3: 1-Benzyl-3-(3-myristoylamino-4-methoxy)-4-(5-bromobenzotriazolyl-1)-5-pyrazolone
DIR C-1: 1-Hydroxy-4-(1-phenyl-5-tetrazolylthio)-N-[γ-(2,4-di-t-amylphenoxy)propyl]-2-naphthamide
DIR C-2: 1-Hydroxy-4-(2-nitrophenylthio)-N-octadecyl-3',5'-dicarboxy-2-naphthanilide
DIR C-3: 1-Hydroxy-4-(1-phenyl-5-tetrazolylthio)-N-(2chloro-5-n-tetradecycloxycarbonylphenyl)-2-naphthamide
DIR C-4: 1-Hydroxy-4-(1-phenyl-5-tetrazolylthio)-N-(2-tetradecyloxyphenyl)-2-naphthamide
DIR U-1: α-(1-Phenyl-5-tetrazolylthio)-2-sulfo-4-n-hexadecyloxyacetophenone potassium salt DIR hydroquinone derivatives which can be advantageously used in the present invention are hydroquinone derivatives substituted in the nucleus with a development inhibitor group, such as those described in U.S. Pat. Nos. 3,297,445, 3,364,022 and 3,379,529. These derivatives release, upon being oxidized through development, a development inhibitor due to the action of a nucleophilic body in the processing solution such as hydroxide ion or sulfite ion. Typical examples of preferred DIR hydroquinone derivatives are the following compounds.

DIR H-1: 2-t-Octyl-5-(1-phenyl-5-tetrazolylthio)hydroquinone
DIR H-2: 2-n-Pentadecyl-5-(1-phenyl-5-tetrazolylthio)-hydroquinone
DIR H-3: 2-n-Octadecylthio-5-(1-phenyl-5-tetrazolylthio)hydroquinone
DIR H-4: 3-n-Octadecylthio-5-phenylthio-6-(1-phenyl-5-tetrazolylthio)hydroquinone The light-sensitive material of the present invention can contain various color-correcting means. When a color negative image is used an an original for color printing, it is useful to incorporate an auto-masking means which corrects unsuitable color reproduction resulting from unnecessary side absorption of dye images undesirable for the color reproduction of subtractive color photography, in order to prepare secondary prints having good color reproducibility. In particular, it is useful to incorporate a means for correcting a green-sensitive emulsion unit by adding yellow and cyan, and a means for correcting a red-sensitive emulsion unit by adding yellow and magenta. Specific means for color correction include a method whose principle is explained in *PSA Journal*, 13, 94 (1947), i.e., a method of incorporating a colored coupler such as a 4-arylazo-5-pyrazolone or a 4-arylazo-α-naphthol in a negative type light-sensitive layer.

Aromatic primary amino developing agents which can be used in the present invention are p-aminophenol, p-phenylenediamine and the derivatives thereof. In particular, 2-chloro-4-aminophenol, 2,6-dichloro-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(δ-sulfobutyl)aniline, 4-amino-N-ethyl-N-(β-hydroxyethyl)aniline, 4-amino-3-methyl-N-ethyl-N-(β-hydroxyethyl)-aniline, 4-amino-N-ethyl-N-(β-carboxyethyl)aniline, 4-amino-N,N-bis(β-hydroxyethyl)-3-methylaniline, 3-acetamido-4-amino-N,N-(β-hydroxyethyl)aniline, 4-amino-N-ethyl-N-(2,3-dihydroxypropyl)-3-methylaniline, 4-amino-N,N-diethyl-3-(3-hydroxypropoxy)-aniline, 4-amino-N-ethyl-N-(β-hydroxyethyl)-3-methoxyaniline, and the salts of these anilines such as the hydrochlorides, sulfates, oxalates, p-toluenesulfonates, etc., are useful. Furthermore, precursors of developing agents such as the Schiff bases of these anilines, imides as described in British Pat. Nos. 775,692, 803,783 and 1,069,061, the derivatives as described in U.S. Pat. No. 3,342,597 and British Pat. No. 1,001,473 and the slightly soluble salts of the developing agents described in U.S. Pat. No. 3,719,492 are useful since they can be added to a light-sensitive element.

The ballasted couplers to be used in the present invention can be dispersed in a carrier, a hydrophilic colloid, using various methods depending upon the type of the dye imageproviding material. For example, couplers having a dissociative group such as a sulfo group or a carboxy group can be added to a hydrophilic colloid solution after being dissolved in water or in an alkaline aqueous solution. With couplers which are slightly soluble in an aqueous medium and readily soluble in an organic solvent, these couplers are first dissolved in an organic solvent, and then the resulting solution is added to a hydrophilic colloid solution, followed by stirring or the like to disperse the solution as fine particles. Suitable solvents are ethyl acetate, tetrahydrofuran, methyl ethyl ketone, cyclohexanone, β-butoxy-β-ethoxyethyl acetate, dimethylformamide, dimethyl sulfoxide, 2-methoxyethanol, tri-n-butylphthalate, etc. Of these dispersion solvents, those solvents which have a comparatively low vapor pressure can be vaporized upon drying of the photographic layers, or can be vaporized according to the method described in U.S. Pat. Nos. 2,322,027 and 2,801,171 prior to coating. Of these dispersion solvents, those solvents which are readily soluble in water can be removed by washing with water according to U.S. Pat. Nos. 2,949,360 and 3,396,027.

In order to stabilize the dispersion of the coupler and accelerate the dye image-forming step, it is advantageous to incorporate, in a light-sensitive element, a solvent which is substantially insoluble in water and having a boiling point of not less than about 200° C under ordinary pressure together with the coupler. Examples of high boiling solvents suitable for this purpose are fatty acid esters such as triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyllaurylamide; hydroxy compounds such as 2,4-di-n-amylphenol; and the like. Furthermore, in order to stabilize the dispersion of coupler and to accelerate the step of dye image formation, it is advantageous to incorporate in a light-sensitive element a polymer miscible with the solvent together with the coupler. Polymers miscible with the solvent and suitable for this purpose are shellac, phenol-formaldehyde condensates, poly-n-butyl acrylate, n-butyl acrylate-acrylic acid copolymers, n-butyl acrylate-styrene-methacrylamide copolymers, and the like. These polymers can be dissolved in an organic solution together with the coupler and then dispersed in a hydrophilic colloid, or can be added, as a hydrosol prepared by emulsion polymerization or the like, to a hydrophilic colloid dispersion of the dye coupler.

In general, the dispersion of the coupler can effectively be conducted under great shearing force. For example, a high speed rotary mixer, a colloid mill, a high pressure milk homogenizer, a high pressure homogenizer described in British Pat. No. 1,304,264, an ultrasonic emulsifying apparatus, and the like are useful. The use of a surface active agent as an emulsifying aid markedly serves to disperse the dye image-providing material. Surface active agents useful for the dispersion of the dye image-providing material to be used in the present invention are sodium triisopropylnaphthalenesulfonate, sodium dinonylnaphthalenesulfonate, sodium p-dodecylbenzenesulfonate, sodium dioctylsulfosuccinate, sodium cetylsulfate and the anionic surface active agents described in Japanese Patent Publication No. 4293/64. The combined use of these anionic surface active agents and higher fatty acid esters of anhydrohexitol exhibits particularly good emulsifying ability as described in U.S. Pat. No. 3,676,141.

The light-sensitive material of the present invention advantageously contains an agent capable of facilitating the removal of silver deposited in a bleaching bath. Since the light-sensitive material of the present invention is in many cases processed with a strongly alkaline processing solution to form silver deposits difficultly removable in a bleaching bath, the use of a silver removal-accelerating agent is particularly effective. Silver removal-accelerating agents which can be used include N-vinylpyrrolidone-containing polymers described in British Pat. Nos. 1,052,487 and 1,226,158, vinyloxazolidone-containing polymers described in British Pat. No. 1,070,688, 2-vinyl-1-methylimidazole-containing polymers described in British Pat. No. 1,080,976, and the like.

The light-sensitive silver halide emulsion to be used in the present invention is a colloidal dispersion of silver chloride, silver bromide, silver chlorobromide, silver bromoiodide, silver chlorobromoiodide or a mixture thereof. The halide composition is selected depending upon the purpose of the end-use of the light-sensitive material and the processing conditions. In particular, a silver bromoiodide emulsion or a silver chlorobromoiodide emulsion containing about 1 mol % to about 10 mol % iodide, not more than about 30 mol % chloride and the balance bromide is advantageous. Useful silver halide grains have a mean grain size of about 0.1 μ to about 2 μ. For some end-use purposes of the light-sensitive material, silver halides having a uniform grain size are desirable. The grains can be in a cubic form, an octahedral form or a mixed crystal form. These silver halide emulsions can be prepared using known conventional processes as described in P. Grafkides, supra, Chapters 18 to 23. That is, a soluble silver salt such as silver nitrate and a water-soluble halide such as potassium bromide are reacted with each other in the presence of a solution of a protective colloid such as gelatin and the grains are allowed to develop in the presence of excess halide or a solvent for silver halide such as ammonia. A single or double jet method or a pAg-controlled double jet method can be employed as the precipitating method. Removal of the soluble salts from the emulsion can be effected by washing and dialysis of the cool-set emulsion, by the combination of the addition of a sedimenting agent such as an anionic polymer having sulfone groups, sulfuric ester groups or carboxy groups or an anionic surface active agent and the adjustment of pH, or by the combination of the use of an acylated protein such as phthaloyl gelatin as a protective colloid and the adjustment of pH, to thereby cause sedimentation.

The silver halide emulsions to be used in the present invention are preferably subjected to chemical sensitization by a heat-treatment using the natural sensitizers contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylenetetramine. Also, emulsions which tend to form latent images on the surface of the silver halide grains can be used with particular advantage, and emulsions which tend to form latent images inside the silver halide grains as described in U.S. Pat. Nos. 2,592,550, 3,206,313, etc., can be used under some conditions.

The silver halide emulsions to be used in the present invention can be stabilized with additives such as 4-hydroxy-6-methyl-1,3,3*a*,7-tetrazaindene, 5-nitroimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of platinum group metals such as a chloro complex salt of palladium, and the like are also useful for stabilizing the light-sensitive material of the present invention. Furthermore, the silver halide emulsions to be used in the present invention can contain sensitizing compounds such as polyethylene oxide compounds.

The photographic emulsion can be subjected, if desired, to a spectral sensitization or a super-sensitization using cyanine dyes (e.g., cyanine, merocyanine, carbocyanine, etc.) alone or in combination, or in combination with a styryl dye, etc. These color sensitizing techniques are well known and are described in, for example, U.S. Pat. Nos. 2,493,748, 2,519,001, 2,997,229, 3,480,434, 3,672,897, 3,703,377, 2,688,545, 2,912,329, 3,397,066, 3,615,635, 3,628,964, British Patents 1,195,302, 1,242,588, 1,293,862, German Patent Application (OLS) Nos. 2,030,326, 2,121,780, Japanese Patent Publication Nos. 4936/68, 14030/69, 10773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. Suitable techniques can optionally be selected depending upon the purpose and end-use of the light-sensitive material such as the sensitivity of the wavelength region to be sensitized and the like. Specific examples of optical sensitizing agents are described in P. Grafkides, supra, Chapters 35 to 41, and F. M. Hamer, *The Cyanine Dyes and Related Compounds* (Interscience). In particular, cyanines in which a nucleus nitrogen atom is substituted with an aliphatic group having a hydroxy group, a carboxy group or a sulfo group, e.g., those described in U.S. Pat. Nos. 2,503,776 3,459,553 and 3,177,210 are especially useful in the practice of the present invention.

The processing solution permeable layers to be used in the present invention such as the silver halide emulsion layer, the dye-forming coupler-containing layer and the auxiliary layers (e.g., a protective layer, an interlayer, etc.) contain a hydrophilic polymer as a binder. Suitable hydrophilic polymers include gelatin, casein, gelatin modified with an acylating agent or the like, vinyl polymer-grafted gelatin, proteings such as albumin, cellulose derivatives such as hydroxyethyl cellulose, methyl Cellosolve, carboxymethyl cellulose, etc., polyvinyl alcohol, partially hydrolyzed products of polyvinyl acetate, polyvinyl pyrrolidone, high molecular weight non-electrolytes such as polyacrylamide, polyacrylic acid, partially hydrolyzed products of polyacrylamide, anionic synthetic polymers such as vinyl methyl ethermaleic acid copolymers, N-vinylimidazole-acrylic acid-acrylamide copolymers, synthetic polymer amphoteric electrolytes such as polyacrylamide which have been subjected to the Hoffman reaction. These hydrophilic polymers can be used individually or in combination. Furthermore, these hydrophilic polymer layers can contain latex-like polymer dispersion of hydrophilic monomers such as alkyl acrylates, alkyl methacrylates, etc.

These hydrophilic polymers, particularly, polymers containing functional groups such as amino groups, hydroxy groups or carboxy groups can be rendered insoluble with various cross-linking agents without loss of processing solution permeability. Particularly useful cross linking agents include aldehyde compounds such as formaldehyde, glyoxal, glutaraldehyde, mucochloric acid, acrolein oligomer, etc.; aziridine compounds such as triethylenephosphoramide described in Japanese Patent Publication No. 8790/62; epoxy compounds such as 1,4-bis-(2',3'-epoxypropoxy)diethyl ether described in Japanese Patent Publication No. 7133/59; active halogen compounds such as 2-hydroxy-4,6-dichloro-s-triazine sodium salt as described in U.S. Pat. No. 3,325,287; active olefin compounds such as hexahydro-1,3,5-triacryl-s-triazine; methylol compounds such as N-polymethylol urea, hexamethylol melamine, etc.; high molecular weight compounds such as dialdehyde starch or 3-hydroxy-5-chloro-s-triazinyl gelatin described in U.S. Pat. No. 3,362,827, etc. These hydrophilic polymer layers can contain a cross linking-accelerating agent such as a carbonate or resorcin as well as the cross linking agent.

The photographic layers to be used in the present invention can be coated using various coating methods such as a dip coating method, a roller coating method, an air knife coating method, a bead coating method described in U.S. Pat. No. 2,681,294, a curtain coating method described in U.S. Pat. Nos. 3,508,947 and 3,513,017. In particular, the multi-layers of light-sensitive elements of a multi-layered structure can be conveniently coated at the same time using a multi-slit hopper described in U.S. Pat. No. 2,716,417, 2,761,418, 2,761,419 and 2,761,791. Suitable coating amounts thereof are about 0.2 to 2 g/m$^2$, preferably about 0.5 to 1.2 g/m$^2$, about 0.4 to 4.0 g/m$^2$, preferably about 0.6 to 1.2 g/m$^2$, and about 0.1 to 2.0 g/m$^2$, preferably about 0.2 to 1.2 g/m$^2$ calculated as Ag in each emulsion layer unit of the spontaneously developable silver salt layer, the first negative type light-sensitive silver halide emulsion layer and the second negative type light-sensitive silver halide emulsion layer, respectively.

In order to facilitate the coating of the photographic layers to be used in the present invention, the coating composition advantageously can contain a variety of surface active agents as a coating aid. Useful coating aids, include nonionic surface active agents such as saponin, p-nonylphenol ethoxyethylene adducts, alkyl ethers of sucrose, glycerin monoalkyl ethers, etc., anionic surface active agents such as sodium dodecylsulfate, sodium p-dodecylbenzenesulfonate, sodium dioctylsulfonsuccinate, etc., and amphoteric surface active agents such as carboxymethyldimethyllaurylammonium hydroxide inner salt, "Deriphat 151" trade name, produced by General Mills, betaine compounds described in U.S. Pat. No. 3,441,413, British Pat. No. 1,159,825 and Japanese Patent Publication No. 21,985/71.

In order to facilitate the coating of the photographic layers to be used in the present invention, the coating composition can contain various thickening agents. For example, in addition to those which increase the viscosity of the coating composition due to their own viscosity such as high molecular weight polyacrylamides, anionic polymers such as cellulose sulfate, poly-p-sulfostyrene potassium salt and acrylic polymers described in U.S. Pat. No. 3,655,407, which exhibit a thickening action due to a mutual interaction with the binder polymer contained in the coating composition can be used.

Furthermore, the processing solution contains a developing agent such as an aromatic primary amino color developing agent, an antioxidant such as a sulfite or ascorbic acid, an antifogging agent such as a halide or 5-nitro-benzimidazole, a silver halide solvent such as thiosulfate or uracil.

The processing composition to be used in the present invention is advantageously retained in a rupturable container. Such a container can be advantageously prepared by folding a sheet of a liquid- and air-impervious material and sealing each edge to form a cavity in which the processing composition is to be retained, and the container is advantageously formed so that, when the film unit is passed through a pressure-applying means, the container is ruptured at a given position due to the inner hydraulic pressure generated within the processing composition to thereby release the contents. A polyethylene terephthalate/polyvinyl alcohol/polyethylene laminate, a lead foil/vinyl chloride-vinyl acetate copolymer laminate or the like can be advantageously used as the material for forming the container. This container is desirably fixedly positioned and extends transverse a leading edge (in the direction of travel) of the film unit whereby a sub-stantially uni-directional discharge of the contents of the container on the surface of the light-sensitive element is achieved. Preferred examples of suitable containers are described in U.S. Pat. Nos. 2,543,181, 2,643,886, 2,653,732, 2,723,051, 3,056,491, 3,056,492, 3,152,515 and 3,173,580. These containers are advantageously in the practice of the present invention.

Also, the processing solution can contain a thickening agent such as hydroxyethyl cellulose. The viscosity of the processing solution to be used is advantageously about 3,000 to 200,000 cp, in particular 1,000 - 100,000 cp.

The image-receiving element to be used in the present invention fixes the dye image-forming materials such as the diffusible dyes, etc. which are to be released with an imagewise distribution from the dye image-providing materials associated with the silver halide emulsions of the light sensitive element. Where dye developers having a hydroquinonyl group or anionic materials such as color dyes having an acidic water-solubilizing group are used as the dye image-forming material, the image-receiving element preferably contains a basic polmer or a basic surface active agent. Those basic polymers, which contain tertiary or quaternary nitrogen atoms are excellent. Suitable cationic quaternary high molecular weight electrolytes, include those described in M. F. Hoover; J. Macromol. Sci., Au, 1327, 1417 (1970). More specifically, illustrative examples include poly-4-vinylpyridine, polymers of the aminoguanidine derivative of vinyl methyl ketone described in U.S. Pat. No. 2,882,156, poly-4-vinyl-N-benzylpyridium p-toluenesulfonate, poly-3-vinyl-4-methyl-N-n-butylpyridium bromide, styrene/N-(3-maleimidopropyl)-N,N-dimethyl-N-4-phenylbenzylammonium chloride copolymers described in British Pat. No. 1,261,925, poly[N-(2-methacryloylethyl)-N,N-dimethyl-N-benzylammonium chloride], etc. Those basic surface active agents which possess an onium residue such as ammonium, sulfonium or phosphonium and possess a hydrophobic residue such as a long-chain alkyl group are excellent. More specifically, N-laurylpyridinium bromide, cetyltrimethylammonium bromide, methyltri-n-laurylammonium p-toluenesulfonate, methyl-ethyl-cetylsulfonium iodide, benzyltriphynylophosphonium chloride, etc. can be umployed. In addition to these basic compounds, multivalent metals such as thorium, aluminum, zirconium, etc. also exert a fixing action on anionic dye-forming materials. These materials advantageously form films together with polymers such as gelatin (in particular acidprocessed gelatin), polyvinyl alcohol, polyacrylamide, polyvinyl methyl ether, hydroxyethyl cellulose, N-methoxymethylpolyhexylmethylene adipamide, polyvinylpyrrolidone, etc. A suitable thickness of the image-receiving layer can range from about 3 to 60 microns, preferably 5 to 20 microns.

The film unit of the present invention can contain a developing agent scavenger which reacts with the excess developing agent remaining after the processing to form a colorless product which is difficult to oxidize. In particular, a film unit which contains the above-described scavenger in the acidic substance-containing neutralizing layer thereof, in the neutralization rate-controlling layer thereof or in the image-receiving layer thereof provides distinct images with less stain. Film units which contain an aromatic primary amine developing agent, which tends to cause stain, advantageously contain a compound having a functional group capable of condensing with amines, such as an isocyanate, an aldehyde precursor and a vinylsulfonyl compound described in German Patent Application OLS Nos. 2,201,392, 2,225,480 and 2,225,497, as the scavenger.

The diffusion transfer photographic film unit of the present invention preferably possesses the function of neutralizing the alkali brought thereinto from the processing composition. The processing composition contains alkali so as to provide a pH of higher than about 10, preferably higher than 11, which is high enough to accelerate the image-forming steps comprising the development of the silver halide emulsion, the formation of the diffusible dye image-forming material and the diffusion. After the substantial completion of the formation of the diffusion transferred images, the pH in the film unit is reduced to around neutrality, i.e., less than about 9, preferably less than 8, whereby further image-formation is actually dissontinued to prevent the image tone from being changed with the lapse of time and to control discoloration and fading of the images and stain of the white background due to high alkalinity. For this purpose, it is advantageous to provide in the film unit a neutralizing layer containing an acidic material in a sufficient quantity to neutralize the alkali contained in the processing composition to the above-described pH, that is, in an area concentrate equivalent to or greater than the amount of alkali contained in the spread processing composition. Preferred acidic materials are those which contain an acidic group of a pKa of less than about 9, particularly a carboxy group or a sulfonic acid group, or contain a precursor group capable of providing such an acidic group upon hydrolysis. More preferred examples are higher fatty acids such as oleic acid described in U.S. Pat. No. 2,983,606, polymers of acrylic acid, methacrylic acid or maleic acid, the partially esterified polymers thereof, or acid anhydrides, described in U.S. Pat. No. 3,362,819. Specific examples of high molecular weight acidic substances include copolymers of a vinyl monomer (e.g., ethylene, vinyl acetate, vinyl methyl ether, etc.) and maleic anhydride, and the n-butyl half ester thereof; copolymer of butyl acrylate and acrylic acid; cellulose acetate hydrogen phthalate; and the like.

In addition to these acidic materials, the neutralizing layer can contain polymers such as cellulose nitrate and polyvinyl acetate, and a plasticizer as described in U.S. Pat. No. 3,557,237. Furthermore, the neutralizing layer can be hardened through a cross linking reaction with a multifunctional aziridine compound, an epoxy compound, etc. The neutralizing layer can be positioned in the image-receiving element and/or the light-sensitive element. In particular, the neutralizing layer can be advantageously positioned between the support of the image-receiving element and the image-receiving layer. The acidic material also can be microencapsulated and incorporated in the film unit as described in German Patent Application OLS 2,038,254. A suitable thickness for the neutralizing layer can range from about 5 to 30 microns.

The neutralizing layer or the acidic material-containing layer to be used in the present invention is desirably separated from the spread processing composition layer by a neutralization rate-controlling layer or timing layer. This timing layer functions to prevent a disadvantageous reduction in the transfer image density due to too fast reduction in the pH before the necessary development of the silver halide umulsion layer and the formation of the diffusion transfer image are completed. That is, the timing layer functions to delay the reduction in the pH until the necessary development and transfer are completed. In a preferable embodiment of the present invention, the image-receiving element has a multi-layered structure comprising a support —a neutralizing layer—a timing layer—amordant layer (image-receiving layer) in this sequence. The timing layer is mainly comprises polymers such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, a copolymer of hydroxyethyl methacrylate and ethyl acrylate, and the like. These polymers are usefully hardened through a cross linking reaction with an aldehyde compound such as formaldehyde or an N-methlylol compound. The timing layer preferably has a thickness of about 2 $\mu$ to 20 $\mu$.

In the film unit of the present invention, a light-reflective material is positioned between the image-receiving layer and the light-sensitive unit surface by the time of the completion of the processing at the latest, in order to form a white background of the dye image to be formed in the image-receiving layer. Suitable light-reflecting materials are titanium dioxide, barium sulfate, zinc oxide, alumina, barium stearate, calcium carbonate, silicate, zirconium oxide, kaolin, magnesium oxide, etc. These materials can be used individually or in combination. The light-reflecting material may be either initially formed or, as is described in Belgian Pat. Nos. 768,110 and 768,111, formed in a given position from a precursor distributed in the film unit. The light-reflecting material can be incorporated in a layer which contains a hydrophilic polymer such as polyvinyl alcohol, gelatin, hydroxypropyl cellulose, polyvinyl pyrrolidone, etc. as a binder. Furthermore, the material can be compounded in the processing composition so that, upon spreading the processing composition, the light reflecting material is fixed in a dispersed state in a layer of a film-forming polymer such as hydroxyethyl cellulose or carboxymethyl cellulose formed upon spreading of the processing solution. The combined use of the light-reflecting material and a fluorescent brightening agent such as a stilbene, a coumarin, a triazine, oxazole, etc., provides a beautiful white background. In order to protect the silver halide emulsion layer from ambient light during processing, e.g., outside a camera, it is advantageous to incorporate, as described in Belgian Pat. Nos. 743,336, 768,107 and 768,109, a dye which is colored at a pH higher than the pKa thereof and is colorless at a pH less than the pKa thereof. The light-reflecting material containing layer advantageously has a light-reflecting material/binder polymer composition ratio (by weight) of about 0.5 to about 100, and has a dry thickness of about 5 $\mu$ to 60 $\mu$. Also, this layer possesses a reflectivity of not less than about 50%, preferably not less than 70%.

The film unit of the present invention includes a rupturable container retaining the processing composition. When pressed by a pressure-applying means, this container is ruptured due to the internal pressure to release the processing composition in a predetermined manner. A variety of pressure-applying members can be used. In particular, a pressure applying means which comprises at least one pair of members juxtaposed with a certain gap or clearance is suitable for the processing of the film unit of the present invention. A pair of members can be fixedly positioned with a certain clearance or can oppose one another through a spring or like elastic body. The members can be rodshaped freely rotating rollers or motor-driven rollers. Upon passing the container between a pair of juxtaposed pressure-applying members, the container is ruptured, and the processing composition is released and spread between two sheets in a layer form. Those juxtaposed pressure-applying members described in U.S. Pat. Nos. 3,647,441 and 3,652,281 can be advantageously used.

The development processing in the film unit of the present invention can be continued outside a camera in a bright place. The silver halide emulsion layers are protected from ambient light until the development and the transfer of the dye images are substantially completed. For this purpose, it is advantageous to provide a light-intercepting layer containing a light absorbent on the silver halide emulsion layer. This light-intercepting layer is either processing composition permeable (hydrophilic) or processing composition impermeable (dimensionally stable), depending upon the position of the layer. The processing composition-permeable light-intercepting layer comprises a water-permeable polymer layer of gelatin, polyvinyl alcohol, polyacrylamide, polyhydroxyethyl cellulose, sodium carboxymethyl cellulose, methly cellulose, etc. containing a light-intercepting material. This layer can be either coated in advance as a pre-formed layer or can be spread upon processing as a processing composition layer. On the other hand, the light-intercepting layer which is processing solution impermeable and is dimensionally stabile comprises a polymer layer containing a light absorbent, which is described in Japanese Patent Publication No. 24547/68 and U.S. Pat. No. 3,607,818. This layer can be incorporated in a film unit as a support or a light-intercepting sheet. Also, this dimensionally stable light-intercepting layer can be prepared from a foil of a metal such as aluminum, tin, etc., a laminate film of a metal foil and a polymer or a polyethylene terephthalate film with aluminum vacuum deposited thereon and a laminate film. From the standpoint of increasing the light-intercepting property and beautiful appearance, the light-intercepting layer preferably is covered with a light-reflecting material such as titanium dioxide.

Various light absorbents can be used in the light-intercepting layer. In particular, carbon power such as carbon black, silver colloid, organic pigments such as azo lake or copper phthalocyanine, water-insoluble azo dyes, an anthraquinone dye dispersion, polymers reacted with a reactive dye, and micelleforming hydrophilic dyes are useful. In many cases, it is necessary for the light-intercepting layer to possess an absorbance (to diffuse light) of not less than about 3, preferably not less than 5, throughout the wave-length region of from about 350 mμ, about 650 mμ, preferably, from about 300 mμ to about 750 mμ, although this depends upon the purpose of the use of the film unit.

The dimensionally stable light-intercepting layer can advantageously be used as an adhesive tape in order to cover the edges of the transparent support, thereby preventing light leakage through the edges of the film unit to the silver halide emulsion layers.

From the film unit of the present invention, a positive image with excellent image quality can be obtained immediately after photographing and, if desired, a color negative thereof can be obtained by merely a simple silver-removing processing. Thus, the defect with the conventional diffusion transfer color photography that only one print can be obtained has now been removed by the film unit of the present invention wherein a conventional ordinary type photographic system will established technically, industrially and commercially, is combined with diffusion transfer color photography.

The film unit of the present invention provides the ability to make secondary print copies having good image quality, allowing trimming, alteration of the image size, color correction and like corrections. The secondary print obtained using the film unit of the present invention possesses the advantages of an ordinary color photographic printing material of high quality, such as stability of dye images and distinctness of colors.

The film unit of the present invention produces less waste since the light-sensitive element is re-used and silver is recovered. Thus, the film unit is desirable from the standpoint of environmental preservation and conservation of resources.

The light-sensitive material and the film unit of the present invention possess the important advantage that a color negative having a particularly excellent image quality can be provided and that the exposure reproduction range in photographing is widened by imparting an extremely large exposure latitude to the light-sensitive material as a negative, as well as the advantages of the above-described diffusion transfer photographic material which can be used as a negative.

The first light-sensitive emulsion layer for supplying a development inhibitor with a negative image distribution to an adjacent colloidal layer containing a spontaneously developable silver salt provides, at the same time, excellent graininess and excellent sharpness, by an adjacent development effect, due to the action of the released development inhibitor without damaging the light sensitivity. This leads to the formation of a corresponding negative color image with excellent image quality. However, the gradation of the first negative type light-sensitive emulsion layer capable of releasing a development inhibitor is limited by the condition for imparting a suitable gradation of a reversal image to be formed in the spontaneously developable silver salt layer. In addition, development in high exposure areas in the first negative type silver halide light sensitive emulsion layer is depressed due to the development inhibition of the released development inhibitor, resulting in an image of plain gradation. Thus, in many cases, the recorded exposure region is so narrow that the material is not sufficiently suitable as a color print original. In the present invention, however, an additional second light-sensitive emulsion layer serves to improve the gradation in, particularly, the high exposure region to thereby provide a wide recording exposure region and a negative gradation suitable as a color print original, together with a good negative image quality. That is, the present invention enables to settle the gradations of a reversal image (positive image) comprising transferred dyes and a negative image comprising fixed dyes according to the respective photographic requirements without being mutually restrained. Thus, a primary print of high quality and, if desired, a plurality of secondary prints having high quality can be obtained. Since color negatives of high quality can be obtained, the image size of diffusion transfer color photograph can be reduced as compared with conventional cases, which leads to the ability to design a compact camera.

The technical achievement reached by the present invention has removed most of the difficulties limiting the use of a diffusion transfer color photograph and, thus, wider applications due combination of diffusion transfer color photography with ordinary type color photography have become possible.

The present invention will now be illustrated in greater detail by the following non-limiting examples of preferred embodiments of the present invention. Unless otherwise indicated herein, all parts, percentages, ratios and the like are by weight.

EXAMPLE 1

On a 100 μ-thick transparent film support of triacetyl cellulose were coated, in sequence, the following 5 layers to prepare a light-sensitive material sampel (a).

1. A diffusible yellow dye-providing layer

To 100 g of a silver bromoiodide emulsion containing 5.7 mol % of iodide (containing 42.0 m mols of silver; grain size distribution of the silver halide dispersion: 0.81 μ as a numerical average and 0.34 μ in standard deviation when approximated with the logarithmic normal distribution hereinafter the same) 2.5 ml of a methyl alcohol solution containing $2 \times 10^{-6}$ mol of N,N'-triethylthiourea was added, followed by heat-processing the mixture at 75° C for 100 minutes under stirring to impart spontaneous developability.

A solution prepared by dissolving 40 mg of a desensitizer having the following structure

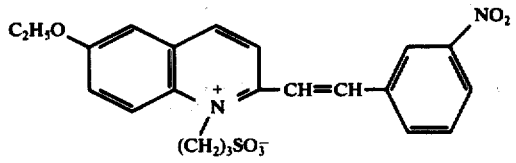

in 10 mol of β-phenoxyethanol under heating was added to 60 ml of an aqueous solution containing 0.3 g of sodium p-dodecylbenzenesulfonate and 6.0 g of gelatin and vigorously stirred to form a dispersion. 15 g of this dispersion was added to the above-described spontaneously developable emulsion, followed by stirring for 30 minutes.

A solution at 80° C comprising 4.9 g of a diffusible yellow dye-forming coupler, α-pivaloyl-α-(4-octadecyloxycarbonylphenoxy)-3.5-dicarboxyacetanilide, 0.4 g of 2.5-di-t-octylhydroquinone, 8 ml of N,N-diethyllaurylamide, 0.2 g of sorbitan monolaurate and 10 ml of cyclohexanone was added to an aqueous solution containing 4 g of gelatin and 0.3 g of sodium bis(2-ethylhexyl)-α-sulfosuccinate, and the mixture was mechanically vigorously stirred at 45° C for 15 minutes to finely emulsify the coupler. The thus obtained emulsified product was added to the above-described emulsion and, after adding thereto 3 ml of an aqueous solution containing 0.15 g of an aqueous solution containing 0.15 g of 1-hydroxy-3.5-dichloro-s-triazine sodium salt, the emulsion was coated in a dry thickness of 3.5 μ as a first layer.

2. Interlayer

A layer comprising 1.5 mg/100 cm² of 2,5-di-tert-octylhydroquinone, 3 mg/100 cm² of di-n-butyl phthalate and 13.5 mg/100 cm² of gelatin was provided as a second layer.

3. First blue-sensitive silver halide emulsion layer

A solution at 80° C comprising 3.6 g of α-benzoyl-α-(1-phenyl-5-tetrazolylthio)-aceto-2-methoxy-5-n-tetradecyloxycarbonylanilide (DIR Y-3), 1.0 g of a copolymer of vinyl acetate and N-vinylpyrrolidone (molecular weight: about 50,000; monomer molar ratio: 3 : 7), ml of tri-o-cresyl phosphate and 5 ml of ethyl acetate was added to an aqueous solution containing 4 g of gelatin and 0.3 g of sodium bis (2-ethylhexyl)-α-sulfosuccinate, and the mixture mechanically vigorously stirred at 45° C for 15 minutes to finely emulsify the coupler.

To 100 g of a silver bromoiodide emulsion containing 6.0 mol % of iodide (content of silver; 62 m mols; grain size distribution of the silver bromoiodide emulsion: 1.2 μ as a numerical average and a standard deviation of 0.43 μ) was added the above-described coupler emulsion and, after adding thereto 3 ml of an aqueous solution containing 0.15 of 1-hydroxy-3, 5-dichloro-s-triazine sodium salt, the emulsion was coated in a dry thickness of 2.5 μ.

4. Second blue-sensitive silver halide emulsion layer

A solution at 80° C comprising 5.6 g of α-(4-methoxybenzoyl)-α-(5.5-dimethyl-3-hydantoinyl)-aceto-2-chloro-5-[α-(2,4-di-tertamylphenoxy)-butyramido]anilide (Y-9), 0.4 g of n-pentadecylhydroquinone, 5 ml of di-n-butyl phthalate and 10 ml of ethyl acetate was added to an aqueous solution containing 5 g of gelatin and 0.4 g of sodium bis-(2-ethylhexyl)-α-sulfosuccinate salt, and the mixture was mechanically vigorously stirred at 45° C for 15 minutes to finely emulsify the coupler.

To 100 g of a silver bromoiodide emulsion containing 7.2 mol % of iodide (content of silver: 45 m mol; numerical average size of silver halide dispersion: 0.48 μ; grain size distribution: standard deviation of 0.18 μ was added in the above-described coupler emulsion and, after adding thereto 6 ml of an aqueous solution containing 0.3 g of 1-hydroxy-3,5-dichloro-s-triazine sodium salt, the emulsion was coated in a dry thickness of 1.3 μ

5. Protective layer

A gelatin layer of a dry thickness of 1.0 μ.

As a control sample, Sample (b) having exactly the same structure as above except for the lack of the fourth layer, and Sample (c) wherein only the fourth and fifth layers were directly coated on the film support were prepared.

An image-receiving layer comprising a paper support, which was coated on both sides with polyethylene, having on one side thereof a dye image-receiving layer comprising 35 mg/100 cm² of poly-4-vinylpyridine, 15 mg/100 cm² of poly(2-methacrylethyltrimethyl ammonium methylsulfate) and 80 mg/100 cm² of polyvinyl alcohol, hardened with formaldehyde, was prepared.

After a 20 CMS exposure of light-sensitive element Samples (a), (b) and (c) through an optical wedge for sensitometry and a blue filter, each sample was superposed on the image-receiving layer of the image receiving element in a face-to-face alignment, and a viscous processing solution of the following composition was spread between the emulsion layer and the dye image-receiving layer at 25° C in a thickness of 80 μ.

| Viscous Solution (A) | | |
|---|---|---|
| Ascorbic Acid | 0.2 | g |
| 3-Methyl-4-amino-N-ethyl-N-(β-hydroxyethyl)aniline sulfate | 30.0 | g |
| Potassium Bromide | 1.4 | g |
| Trisodium Phosphate (dodecahydrate) | 20.0 | g |
| Sodium Hydroxide | 40.0 | g |
| Hydroxyethyl Cellulose | 30.0 | g |
| Water | 880 | ml |
| (viscosity: 30,000 cp at 25° C) | | |

After maintaining at the same temperature for 3 minutes, the image-receiving element was manually separated from the light-sensitive element, the processing solution layer was removed in a 0.5% acetic acid solution, and the image-receiving element was washed with water for 1 minute and dried to obtain color prints having a yellow reversal image.

The processing solution layer was removed from the light-sensitive element using dilute acetic acid, then the light-sensitive material was subjected to the following silver-removal processing, followed by drying to obtain yellow color negatives.

| | | |
|---|---|---|
| 1. Alkaline Processing Bath | 24° C | 25 min. |
| 2. Bleaching Bath | 24°C | 6 min. |
| 3. Fixing Bath | 24° C | 4 min. |
| 4. Washing | 16° C | 10 min. |

The compositions of the processing solutions used were as follows.

1. Alkaline Processing Bath

-continued

| | | |
|---|---|---|
| Sodium Carbonate | 30 | g |
| Sodium Bicarbonate | 5 | g |
| Water to make | 1 | liter |
| 2. Bleaching Bath | | |
| Potassium Bromide | 20.0 | g |
| Potassium Dichromate | 5.0 | g |
| Potassium Alum | 40.0 | g |
| Sodium Acetate | 2.5 | g |
| Glacial Acetic Acid | 60.0 | ml |
| Water to make | 1 | liter |
| 3. Fixing Bath | | |
| Sodium Hexametaphosphate | 1 | g |
| Sodium Sulfite | 5 | g |
| Sodium Thiosulfate | 150 | g |
| Acetic Acid | 8 | ml |
| Water to make | 1 | liter |

FIG. 1 shows the characteristic curves of the reversal images of the color prints obtained by combining, respectively, Sample (a) and Sample (b) therewith. FIG. 2 shows the characteristic curves of the respective color negatives of Samples (a), (b) and (c). These results clearly show that light-sensitive material of the present invention, Sample (a) provides both a print having a suitable gradation for direct viewing and a color negative having a suitable gradation for printing on a conventional color print material and a broad latitude. In contrast, the control, Sample (b), without the second light-sensitive emulsion layer for adjusting the gradation provides an unsuitable negative for printing, although a print having good gradation is provided, and hence secondary prints can be prepared only when combined with a color print material having a special corresponding gradation. In addition, the reproducible exposure range as a negative is narrow.

EXAMPLE 2

On a 100 μ-thick triacetyl cellulose transparent film support were coated, in sequence, the following 5 layers to prepare a light-sensitive material, Sample (d).

1. Diffusible cyan dye-providing layer

A layer of a silver bromoiodide emulsion (iodide content; 5.7 mol %; means grain size: 0.81 μ) processed in the same manner as in Example 1 containing silver at a coverage of 0.63 g/m², a diffusible cyan dye-forming coupler, 1-hydroxy-4-n-hexadecyloxy-N-ethyl-3',5'-dicarboxy-2-naphthanilide, at a coverage of 1.18 g/m², 2.5-di-tert-oxtylhydroquinone at a coverage of 0.1 g/m², a copolymer of N-vinylpyrrolidone and vinyl acetate (monomer molar ratio 7 : 3) at a coverage of 0.3 g/m², N,N-diethyllaurylamide at a coverage of 0.7 g/m², and gelatin at a coverage of 4.0 g/m².

2. Interlayer

A layer comprising 0.1 g/m² of n-pentadecylhydroquinone, 0.2 g/m² of di-n-butyl phthalate and 2.0 g/m² of gelatin.

3. First red-sensitive silver halide emulsion layer

A layer of a silver bromoiodide emulsion (iodide content: 5.7 mol %; mean grain size; 0.81 μ) red-sensitized with the following panchromatically sensitizing agents

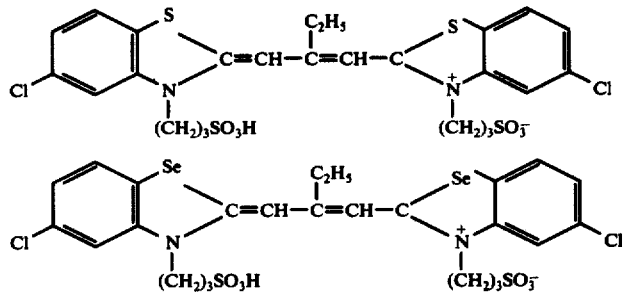

and containing silver at a coverage of 1.0 g/m², 1-hydroxy-4-(1-phenyl-5-tetrazolylthio)-N-[γ-(2.4-di-tert-amylphenoxy)propyl]-2-naphthamide at a coverage of 0.52 g/m², 1-hydroxy-4-chloro-N-[γ-(2,4-di-tert-amylphenoxy)-propyl]-2-naphthamide at a coverage of 0.17 g/m², di-n-butyl phthalate at a coverage of 0.7 g/m² and gelatin at a coverage of 3.2 g/m².

4. Second red-sensitive silver halide emulsion layer

A layer of a silver bromoiodide emulsion (iodide content: 7.2 mol %; means grain size: 0.48 μ) red-sensitized with the above-described panchromatically sensitizing agents and containing silver at a coverage of 0.31 g/m², 1-hydroxy-4-chloro-N-[γ-(2.4-di-tert-amylphenoxy)propyl]-2-naphthamide at a coverage of 0.11 g/m², 1-hydroxy-4-(1-phenyl-5-tetrazolylthio)-N-[γ-(2.4-di-tert-amylphenoxy)-propyl ]-2-naphthamide at a coverage of 0.03 g/m², di-n-butyl phthalate at a coverage of 0.3 g/m² and gelatin at a coverage of 1.3 g/m².

5. Protective layer

A gelatin layer of a dry thickness of 110 μ.

These photographic layers were hardened with triethylene phosphoramide.

The thus prepared light-sensitive material, Sample (d) was subjected to a red light exposure for sensitometry according to the procedures in Example 1, processed by spreading Viscous Processing Solution A of Example 1, and separation of layers and removal of silver from the light-sensitive material were conducted to obtain a cyan transfer positive print and a cyan negative.

FIG. 3 shows the characteristic curves of the reversal image of the color print and the negative image obtained. These results show that light-sensitive material of the present invention Sample (d) provides both a print having a suitable gradation for direct viewing and a negative having a suitable gradation for printing on a conventional color print material and a broad latitude.

FIG. 4 show the results of sensitometry of Samples (e) and (f) which were prepared by coating, respectively, the first and the second light-sensitive emulsion layers used as the third and the fourth layers of light-sensitive material, Sample (d) independently on a transparent support at the same coverage.

EXAMPLE 3

On a 100 μ-thick transparent triacetyl cellulose film support were coated, in sequence, the following 4 layers to prepare a light-sensitive material Sample (g).

1. Diffusible magenta dye-providing layer

A layer of a low sensitivity silver chlorombromide emulsion (bromide content: 15 mol %; means grain size: 0.42 μ) which was not chemically sensitized and which contained silver at a coverage of 0.78 g/m², colloidal silver sulfide nuclei (particle size: about 5 mμ) at a coverage of 9 mg/m² of silver, a diffusible magenta dye-forming coupler, 1-(1-methylphenyl)-3-(3,5-di-carboxyanilino)-4-(3-octadecylcarbamylphenylthio)-5-pyrazolone at a coverage of 0.91 g/m², n-pentadecylhydroquinone at a coverage of 0.10 g/m², N-vinylpyrrolidone-vinyl acetate copolymer (monomer molar ratio 7 : 3) at a coverage of 0.18 g/m², N,N-diethyllaurylamide at a coverage of 1.3 g/m² and gelation at a coverage of 3.7 g/m².

2. First green-sensitive silver halide emulsion layer

A layer of silver bromoiodide emulsion (iodide content: 5.7 mol %; mean grain size: 0.81 μ) having been green-sensitized with the following orthochromatically sensitizing agents

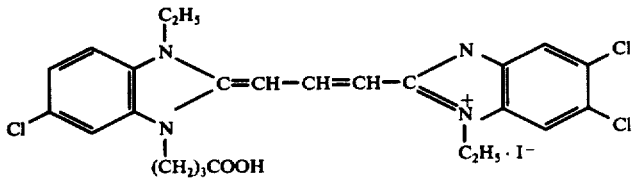

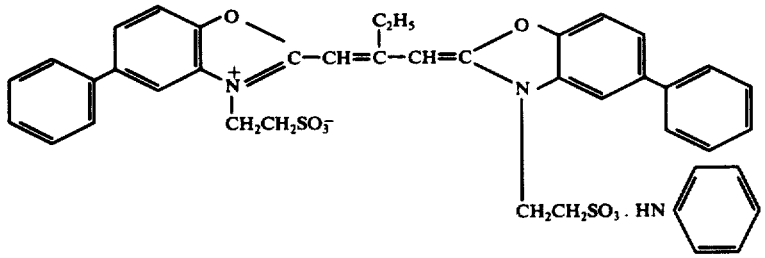

and containing silver at a coverage of 1.21 g/m², 3-n-octadecyl-thio-5-phenylthio-6-(1-phenyl-5-tetrazolythio)hydroquinone at a coverage of 0.75 g/m², 2.5-di-tert-octylhydroquinone at a coverage of 0.15 g/m², tri-o-cresyl phosphate at a coverage of 1.2 g/m² and gelatin at a coverage of 5.5 g/m².

3. Second green-sensitive silver halide emulsion layer

Two emulsions were mixed and green-sensitized with the above-described orthochromatically sensitizing agents. That is, 60 g of a first silver bromoiodide emulsion (iodide content: 5.7 mol %; mean grain size: 0.81 μ) containing 25 m mol of silver was mixed with a second silver bromoiodide emulsion (iodide content: 7.2 mol %; mean grain size: 0.48 μ) containing 63 m mols of silver. This mixed emulsion was coated at a coverage of 1.1 g/m² of silver, 0.67 g/m² of 1-(2,4,6-trichlorophenyl)-3-{3-[α-(2,4-di-tertamylphenoxy)butyramido ]benzoylamido}-5-pyrazolone, 0.4 g/m² of 3-n-octadecyloxy-5-phenyl-6-(1-phenyl-5-tetrazolythio)-hyroquinone, 0.07 g/m² of 2,5-di-tert-octylhydroquinone, 1.5 g/m² of tri-o-cresyl phosphate and 2.4 g/m² of gelation.

4. Protective layer

A layer comprising gelatin in a thickness of 1 μ.

These photograhic layers were hardened with triethylene phosphoramide.

The thus prepared light-sensitive material, Sample (g), was subjected to green light exposure for sensitometry according to the procedures in Example 1, processed by spreading the viscous processing solution, and separation of layers and removal of silver from the light-sensitive element were consecutively conducted to obtain a magenta transfer positive print and a magenta negative.

FIG. 5 shows the characteristic curves of the reversal image of the color print and the negative image obtained. These results show that the light-sensitive material of the present invention, Sample (g), provides both a print having a suitable gradation for direct viewing and a negative having a suitable gradation for printing on a conventional color print material and a broad tolerance.

EXAMPLE 4

A film unit analogous to that shown in FIGS. 2 and 9 of U.S. patent application Ser. No. 476,241, filed June 4, 1974, was prepared using a material having the structure shown in FIG. 6 of the accompanying drawings.

In FIG. 6, numeral 1 designates a light-sensitive element, numeral 2 an image-receiving element, numeral 3 a rupturable container retaining a processing solution, and numeral 4 designates a light-intercepting sheet for protecting the image-receiving element from ambient light.

I. Light-sensitive material 1

On the back side of a 130 μ-thick transparent triacetyl cellulose film support 31 was coated backing layer 30 containing 1.0 g/m² of polydimethylsiloxane (degree of polymerization: 50), 2.5 g/m² of stearic acid amide, 0.85 g/m² of 2-(2-hydroxy-4-t-butylphenyl)-benzotriazole and 9.4 g/m² of gelatin and, on the other side thereof, the following 16 layers were coated in sequence to prepare a light-sensitive element.

1. Diffusible yellow dye-providing layer 32

A layer comprising 0.65 g of silver/m²of spontaneously developable silver bromoiodide grains, 1.0 g/m² of a diffusible yellow dye-providing coupler. α-pivaloyl-α-(4-octadecyloxycarbonylphenoxy)-3,5-dicarboxyacetanilide, 1.5 g/m² of N,N-diethyllaurylamide, and 2.7 g/m² of gelatin.

2. Interlayer

A layer comprising 0.15 g/m² of n-pentadecylhydroquinone, 0.3 g/m² di-n-butyl phthalate and 1.4 g/m² of gelatin.

3. First blue-sensitive silver halide emulsion layer 34

A layer comprising 1.2 g of silver/m² of blue-sensitive silver bromoiodide grains, 0.75 g/m² of α-(p-n-octadecyloxybenzoyl)-α-(5-bromobenzo-1-benzotriazolyl)-aceto-2-methoxyanilide (DIR Y-4), 0.21 g/m² of vinyl acetate-N-vinylpyrrolidone copolymer (monomer molar ratio 3:7) 0.9 g/m² of tri-o-cresyl phosphate, and 4.2 g/m² of gelatin.

4. Second blue-sensitive silver halide emulsion layer 35

A layer comprising 0.25 g of silver/m² of blue-sensitive silver bromoiodide grains, 0.18 g/m² of a yellow color-forming coupler, α-(p-methoxybenzoyl)-α-(5,5-dimethyl-3-hydantoinyl)-aceto-2-chloro-5-[α-(2,4-di-tert-amylphenoxy)butyramido]anilide, 0.2 g/m² of di-n-butyl phthalate and 1.9 g/m² of gelatin.

5. Yellow filter layer 36

A 2.0 μ-thick gelatin layer containing 0.35 g silver/m² of a Carey-Lea type silver colloid.

6. Diffusible magenta dye-providing layer 37

A layer comprising 0.60 g of silver/m² of spontaneously developable silver bromoiodide grains, 0.75 g/m² of a diffusible magenta dye-providing coupler, 1-(1-methylphenyl)-3-(3,5-dicarboxyanilino)-4-(3-octadecylcarbamylphenylthio)-5-pyrazolone, 0.06 g/m² of n-pentadecylhydroquinone, 0.91 g/m² of N,N-diethyllaurylamide and 2.8 g/m² of gelatin.

7. Interlayer 38

A layer comprising 0.15 g/m² of n-pentadecylhydroquinone, 0.3 g/m² of di-n-butyl phthalate and 1.4 g/m² of gelatin.

8. First green-sensitive silver halide emulsion layer 39

A layer comprising 1.05 g of silver/m² of silver bromoiodide grains green-sensitized with the orthochromatically sensitizing agents described in Example 3, 0.85 g/m² of 1-{4-[α-(2,4-di-tert-amylphenoxy)-butyramido]phenyl}-3-N-piperidino-4-(1-phenyl-5-tetrazolylthio)-5-pyrazolone (DIR M-1), 0.30 g/m² of 1-(2,4,6-trichlorophenyl)-3-{-(2,4-di-tert-amylphenoxyl)-butyramido]-benzoylamido}-5-pyrazolone, 0.15g/m² of n-pentadecylhydroquinone, 0.3 g/m² of vinyl acetate-N-vinylpyrrolidone copolymer (monomer molar ratio 3:7), 1.2 g/m² of tri-o-cresyl phosphate and 2.4 g/m² of gelatin.

9. Second green-sensitive silver halide emulsion layer 40

A layer comprising 0.25 g of silver/m² of silver bromoiodide grains green-sensitized with the orthochromatically sensitizing agents described in Example 3, 0.31 g/m² of 1-(2,4,6-trichlorophenyl)-3-{3-[α-(2,4-di-tert-amylphenoxy)butyramido]benzoylamido}-5-pyrazolone, 0.02 g/m² of 1-{4-[α-(2,4di-tert-amylphenoxy)butyramido]-phenyl}-3-N-piperidino-4-(1-phenyl-5-tetrazolylthio)-5-pyrazolone, 0.5 g/m² of tri-o-cresyl phosphate, and 0.9 g/m² of gelatin.

10. Intercepting layer 41

A layer comprising 0.5 g/m² of an extremely low sensitivity silver bromoiodide emulsion (iodide content: 25 mol %; mean grain size: 0.06 μ), 0.3 g/m² of n-pentadecylhydroquinone, and 2.0 g/m² of gelatin.

11. Diffusible cyan dye-providing layer 42

A layer comprising 0.48 g/m² of spontaneously developable silver bromoiodide grains, 0.85 g/m² of a diffusible cyan dye-providing coupler, 1-hydroxy-4-n-hexadecyloxy-N-ethyl-3',5'-dicarboxy-2-naphthanilide, 0.09 g/m² of n-pentadecylhydroquinone, 1.0 g/m² of N,N-diethyllaurylamide and 3.4 g/m² of gelatin.

12. Interlayer 43

A layer comprising 0.15 g/m² of n-pentadecylhydroquinone, 0.3 g/m² of di-n-butyl phthalate and 1.4 g/m² of gelatin.

13. First red-sensitive silver halide emulsion layer 44

A layer comprising 0.75 g of silver/m² of silver bromoiodide grains red-sensitized with the panchromatically sensitizing agents described in Example 2, 0.40 g/m² of 1-hydroxy-4(1-phenyl-5-tetrazolylthio)-N-(2-tetradecyloxyphenyl)-2-naphthamide (DIR C-4), 0.10 g/m² of 1-hydroxy-4-chloro-N-[γ-(2,4-di-tertmylphenoxy)propyl]-2-naphthamide, 0.05 g/m² of n-pentadecylhydroquinone, 0.15 g/m² of vinyl acetate-N-vinylpyrrolindone copolymer (Monomer molar ratio 3:7), 0.6 g/m² of di-n-butyl phthalate and 2.5 g/m² of gelatin.

14. Second red-sensitive silver halide emulsion layer 45

A layer comprising 0.24 g of silver/m² of silver bromoiodide grains red-sensitized with the panchromatically sensitizing agents described in Example 2, 0.09 g/m² of 1-hydroxy-4-chloro-N-[γ-(2,4-di-tert-amylphenoxy)propyl]-2-naphthamide, 0.2 g/m² of 1-hydroxy-4-(1-phenyl-5-tetrazolylthio)-N-[γ-(2,4-di-tert-amylphenoxy)propyl]-2-naphthamide, 0.15 g/m² of di-n-butyl phthalate and 0.8 g/m² of gelatin.

Each of these layers (first layer to fourteenth layer, i.e., layers 32 to 45) was hardened by incorporating about 5% by weight, based on the gelatin, of 4-chloro-6-hydroxy-s-triazinyl-2-gelatin prepared as described in Example 1 of U.S. Pat. No. 3,362,827.

15. Interlayer

A layer of unhardened polyvinyl alcohol (mean molecular weight: 10,000) of a thickness of 0.5 μ.

16. Light-intercepting layer

A layer comprising 3.4 g/m² of carbon black (furnace type; particle size: 27 μ) and 2.2 g/m² of unhardened gelatin.

II. Image-receiving element 2

On one side of a 130 μ-thick transparent triacetyl cellulose film support 50 were coated, in sequence, the following 4 layers to prepare an image-receiving layer.

1. Polymer acid layer 51

A layer containing 19.5 g/m² of polyacrylic acid (mean molecular weight: 450,000), 5 g/m² of formaldehyde-sodium bisulfite adduct, and 0.8 g/m² of 1,4-bis(2',3'-epoxypropoxy)butane as a cross linking agent.

2. Timing layer 52

A layer of 6.5 g/m² of polyvinyl acetate (mean molecular weight 75,000; saponification degree: 20%).

3. Dye-receiving layer 53

A layer containing 3.5 g/m² of poly-4-vinylpyridine, 1.5 g/m² of poly-(2-methacrylethyltrimethylammonium methylsulfate), 8.0 g/m² of polyvinyl alcohol (mean molecular weight: about 75,000), 0.4 g/m² of N-methylolmelamine as a cross linking agent, and 3 g/m² of formaldehyde-sodium bisulfite adduct.

4. Light-reflecting layer 54

A layer containing 10.0 g/m² of titanium dioxide particles (rutile type), 0.2 g/m² of 2,5-di-tert-butylhydroquinone, 2.0 g/m² of polyvinyl alcohol (mean molecular weight: about 75,000), and 0.1 g/m² of hexa-N-methylolmelamine as a cross linking agent.

III. Light-intercepting sheet 3

A 85 μ-thick sheet of vinyl chloride-vinyl acetate copolymer containing 10% by weight carbon black and 15% by weight of di-n-butyl phthalate.

IV. Processing solution container 4

A small container retaining processing solution 73 having the following composition and an opening weakly adhered with vinyl chloride-acrylonitrile copolymer layer 72 so as to be ruptured by applying pressure, which container was formed by folding lead foil 70 the in side of which was lined with vinyl chloride-vinyl acetate copolymer layer 71.

| Viscous processing solution (B): | | |
|---|---|---|
| Piperidinohexose Reductone | 0.4 | g |
| Ascorbic Acid | 0.05 | g |
| 3-Methyl-4-amino-N-ethyl-N-(β-hydroxyethyl)-aniline Sulfate | 30 | g |
| 3-Methoxy-4-amino-N-ethyl-N-(β-hydroxyethyl)aniline Sulfate | 5 | g |
| Potassium Bromide | 1.4 | g |
| Trisodium Phosphate(dodecahydrate) | 30 | g |
| Sodium Hydroxide | 45 | g |
| 1-Hydroxy-4-sulfo-N-octadecyl-2-naphthamide | 15 | g |
| Hydroxyethyl Cellulose | 30 | g |
| Titanium Dioxide | 100 | g |
| Water | 750 | ml |
| (viscosity: 30,000 cp at 25° C) | | |

This film unit was loaded in a camera and light-sensitive element 1 was imagewise exposed from the support side. The light-sensitive element was then inserted into an envelope-shaped composite of image-receiving element 2 and light-intercepting sheet 3 with processing solution container 4 positioned at the leading end, and the processing solution was spread between the light-sensitive layer and the image-receiving layer in a thickness of 100 μby passing the composite through pressure-applying rollers. After spreading the solution, the composite was withdrawn from the camera into a bright place. After about 2 minutes, the appearance of an image was observed. About 30 hours after spreading the solution, the image-receiving element and the light-sensitive element were separated from the film unit, and the light-sensitive element was subjected to the silver-removal processing as in Example 1, followed by processing in running water at 45° C to remove light-intercepting layer 47, thus obtaining a color negative.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material which comprises a transparent support having thereon at least three silver halide emulsion layer units, each of which is sensitive to a different wavelength region of light and capable of simultaneously providing, as a result of exposure and development, both a diffusable dye with a positive image distribution and non-diffusible dye with a negative image distribution, these units including I. a blue sensitive emulsion layer unit comprising (1) a hydrophilic collodial layer containing a ballasted yellow coupler capable of reacting with an oxidation product of an aromatic primary amine color developing agent to form a diffusible yellow dye, and a spontaneously developable, slightly soluble silver salt dispersion, (2) a first negative type blue-sensitive silver halide emulsion layer provided adjacent said colloidal layer (1) and containing a ballasted compound capable of reacting with an oxidation product of an aromatic primary amine color developing agent to release a diffusible development inhibitor inhibiting the development of said silver salt in the above described colloidal layer (1), and (3) a second negative type blue-sensitive silver halide emulsion layer containing a ballasted yellow coupler capable of reacting with an oxidation product of an aromatic primary amine color developing agent to release a nondiffusible yellow dye image having a negative gradation suitable as an original for color printing in cooperation with said silver halide emulsion layer (2);

II. a green-sensitive emulsion layer unit comprising (1) a hydrophilic colloidal layer containing a ballasted magenta coupler capable of reacting with an oxidation product of an aromatic primary amine color developing agent to form a diffusible dye, and a spontaneously developable, slightly soluble silver salt dispersion, (2) a first negative type green-sensitive silver halide emulsion layer provided adjacent said colloidal layer (1) and containing a ballasted compound capable of reacting with an oxidation product of an aromatic primary amine color developing agent to release a diffusible development inhibitor inhibiting the development of said silver salt in the above described colloidal layer (1), and (3) a second negative type green-sensitive silver halide emulsion layer containing a ballasted magenta coupler capable of reacting with an oxidation product of an aromatic primary amine color developing agent to release a non-diffusible magenta dye and providing a dye image having a negative gradation suitable as an original for color printing in cooperation with said silver halide emulsion layer (2); and III. a red-sensitive emulsion layer unit comprising (1) a hydrophilic colloidal layer containing a ballasted cyan coupler capable of reacting with an oxidation product of an aromatic primary amine color developing agent to form a diffusible dye, and a spontaneously developable, slightly soluble silver salt dispersion, (2) a first negative type red-sensitive silver halide emulsion layer provided adjacent said colloidal layer (1) and containing a ballasted compound capable of reacting with an oxidation product of an aromatic primary amine color developing agent to release a diffusible development inhibitor inhibiting the development of said silver salt in the above described colloidal layer (1), and (3) a second negative type red-sensitive silver halide emulsion layer containing a ballasted cyan coupler capable of reacting with an oxidation product of an aromatic primary amine color developing agent to release a non-diffusible cyan dye and providing a cyan image having a negative gradation suitable as an original for color printing in cooperation with said silver halide emulsion layer (2).

2. The light-sensitive material as described in claim 1, wherein the blue-sensitive emulsion layer unit (I), the green-sensitive emulsion layer unit (II) and the red-sensitive emulsion layer unit (III) are disposed in this order in the direction of imagewise exposure.

3. The light-sensitive material as described in claim 1, wherein the blue-sensitive emulsion layer unit (I), the red-sensitive emulsion layer unit (III) and the green-sensitive emulsion layer unit (II) are disposed in this order in the direction of imagewise exposure.

4. The light-sensitive material as described in claim 1, including a yellow filter interposed between the blue-sensitive emulsion layer unit (I) and the green-sensitive unit (II) or the red-sensitive unit (III).

5. The light-sensitive material as described in claim 1 wherein at least one of the emulsion layer units comprises, a sequence in the direction of the permeation of the processing solution, the second negative type light-sensitive silver halide emulsion layer (3) the first negative light-sensitive silver halide emulsion layer (2) and the spontaneously developable silver salt-containing hydrophilic colloidal layer.

6. The light-sensitive material as described in claim 1, wherein in at least one of the emulsion layer units, the first negative type light-sensitive silver halide emulsion layer (2) is positioned between two spontaneously developable silver salt-containing colloidal layers (1), and the second negative type light-sensitive silver halide emulsion layer (3) is disposed closer to incident light of exposure.

7. The light-sensitive material as described in claim 1, wherein in at least one of the emulsion layer units, the first negative type silver halide emulsion layer (2) or the second negative type silver halide emulsion layer (3) is separated from the spontaneously developable silver salt-containing colloidal layer (1) by an interlayer comprising a hydrophilic colloid.

8. The light-sensitive material as described in claim 7, wherein said interlayer contains a component capable of preventing interlayer migration of an oxidation product of the color developing agent.

9. The light-sensitive material as described in claim 7, wherein said interlayer contains a ballasted dihydroxybenzene.

10. The light-sensitive material as described in claim 9, wherein said ballasted dihydroxybenzene is a ballasted hydroquinone.

11. The light-sensitive material as described in claim 1, wherein two of the emulsion layer units are separated from each other by an interlayer comprising a hydrophilic colloid.

12. The light-sensitive material as described in claim 11, wherein said interlayer contains a component capable of preventing interlayer migration of an oxidation product of the color developing agent.

13. The light-sensitive material as described in claim 11, wherein said interlayer contains a component capable of preventing migration of a released development inhibitor between emulsion layer units.

14. The light-sensitive material as described in claim 12, wherein said interlayer contains a ballasted dihydroxybenzene as the component for preventing migration of an oxidation product of the color developing agent.

15. The light-sensitive material as described in claim 10, wherein said interlayer contains a ballasted hydroquinone as an agent for preventing migration of an oxidation product of the color developing agent.

16. The light-sensitive material as described in claim 13, wherein said interlayer contains silver halide fine particles or metallic silver fine particles as an agent for preventing the migration of the development inhibitor.

17. The light-sensitive material as described in claim 1, wherein the development inhibitor to be released from the first negative type light-sensitive emulsion layer (2) of at least one of said emulsion layer units is a diffusible arylmercapto compound or a hetero ring mercapto compound.

18. The light-sensitive material as described in claim 1, wherein the development inhibitor released from the first negative type light-sensitive emulsion layer (2) of at least one of said emulsion layer units is a diffusible benzotriazole compound.

19. The light-sensitive material as described in claim 1, wherein at least one of said emulsion layer units, the first negative type light-sensitive emulsion layer (2) contains a ballasted color coupler capable of forming a non-diffusible dye, in addition to the development inhibitor-releasing compound, said ballasted compound being present in an amount of not less than about 20 mole percent based upon both the ballasted compound to release the diffusible development inhibitor and the ballasted coupler to release non-diffusible dye.

20. The light-sensitive material as described in claim 1, wherein in at least one of said emulsion layer units, the ballasted compound in the first negative-type light-sensitive emulsion layer (2) is a development inhibitor-releasing coupler.

21. The light-sensitive material as described in claim 1, wherein in at least one of said emulsion layer units, the ballasted compound in the first negative type light-sensitive emulsion layer (2) is a development inhibitor-releasing hydroquinone.

22. The light-sensitive material as described in claim 20, wherein said development inhibitor-releasing coupler is substituted with an arylthio group, a hetero ring thio group or an N-benzotriazolyl group in the reaction site of the coupler.

23. The light-sensitive material as described in claim 21, wherein said development inhibitor-releasing hydroquinone is nucleus-substituted with a hetero ring thio group.

24. The light-sensitive material as described in claim 1, wherein in at least one of said emulsion layer units, the second negative type light-sensitive emulsion layer (3) contains a development inhibitor-releasing compound comprising about 20 mol % or less of the coupling components within the layer.

25. The light-sensitive material as described in claim 1, wherein in at least one of said emulsion layer units, the spontaneously developable silver salt in hydrophilic colloidal layer (1) is a silver halide dispersion chemically rendered spontaneously developable.

26. The light-sensitive material as described in claim 25, wherein said silver halide dispersion contains silver halide grains of a mean grain size of about 0.5 to 2 μ and with about 30% or less in number of the grains having a grain size of about 0.3 μ or smaller.

27. The light-sensitive material as described in claim 1, wherein in at least one of said emulsion layer units, the hydrophilic colloidal layer (1) contains silver-depositing nuclei and a slightly soluble silver salt as said spontaneously developable silver salt.

28. The light-sensitive material as described in claim 27, wherein said silver-depositing nuclei are a heavy metal fine colloid or a metal sulfide fine colloid and the slightly soluble silver salt is an inorganic silver salt or an organic silver salt.

29. The light-sensitive material as described in claim 28, wherein said heavy metal fine colloid is fine colloidal silver, gold, platinum, or palladium; said metal sulfide fine colloid is fine colloidal silver sulfide, gold sulfide, cadmium sulfide or zinc sulfide; said inorganic silver salt is a silver halide, silver thiocyanate of silver phosphate; and said organic silver salt is oxalate or silver tartarate.

30. The light-sensitive material as described in claim 1, wherein in at least one of said emulsion layer units, the light sensitivity as a threshold value of the second negative type light-sensitive emulsion layer (3) ranges from about ⅓ to about 1/10 the sensitivity as a threshold value of the first negative type light-sensitive emulsion layer (2), and both negative type light-sensitive emulsions cooperate with each other to form a negative gradation suitable as an original for color printing.

31. The light-sensitive material as described in claim 1, wherein an surface of the emulsion unit is covered by a removable processing solution-permeable layer having the necessary light-intercepting property to protect the silver halide emulsion layers of the emulsions unit from ambient light while the film is processed outside a camera.

32. The light-sensitive material as described in claim 1, wherein the backside of the support opposite to the emulsion-coated side of the support of the light-sensitive material is covered by a removable layer having the necessary light-intercepting ability to protect the silver-halide emulsion layers from ambient light while the film unit is processed out of a camera.

33. A diffusion transfer color photographic film unit, which is capable of providing, upon development processing, with an aromatic primary amino developing agent, a transferred positive image print and which is capable of providing, after subsequent silver-removal processing, an original negative for color printing, comprising:

i. a light-sensitive element comprising the light-sensitive material as described in claim 2;

ii. an image-receiving element comprising a colloidal layer containing a mordant for receiving diffusible dyes formed upon exposure and development of the light-sensitive element (i); and iii. a processing solution element comprising an alkaline aqueous solution capable of causing, upon being spread on the light-sensitive element (1), development, dye formation and transfer of diffusible dyes formed in said light-sensitive element (1) to said image-receiving element (ii), the aromatic primary amino developing agent being contained in the alkaline aqueous solution capable of causing development or being provided from the light-sensitive element which contains a precursor thereof or a slightly soluble salt thereof.

34. The diffusion transfer film unit as described in claim 33, wherein the blue-sensitive emulsion layer unit (I), the green-sensitive emulsion layer unit (II) and the red-sensitive emulsion layer unit (III) are disposed in this order in the direction of imagewise exposure.

35. The diffusion transfer film unit as described in claim 33, wherein the blue-sensitive emulsion layer unit (I), the red-sensitive emulsion layer unit (III) and the green-sensitive emulsion layer unit (II) are disposed in this order in the direction of imagewise exposure.

36. The diffusion transfer film unit as described in claim 34, including a yellow filter layer interposed between the blue-sensitive emulsion layer unit (I) and the green-sensitive unit (II) or the red-sensitive unit (III).

37. The diffusion transfer film unit as described in claim 33, wherein at least one of the emulsion layer units comprises in sequence in the direction of the permeation of the processing solution, the second negative type light-sensitive silver halide emulsion layer (3), the first negative type light-sensitive silver halide emulsion layer (2), and the spontaneously developable silver salt-containing hydrophilic colloidal layer.

38. The diffusion transfer film unit as described in claim 33, wherein in at least one of said emulsion layer units, the first negative type light-sensitive silver halide emulsion layer (2) is positioned between two spontaneously developable silver salt-containing colloidal layers (1), and the second negative type light-sensitive silver halide emulsion layer (3) is disposed closer in incident light of exposure.

39. The diffusion transfer film unit as described in claim 33, wherein in at least one of said emulsion layer units, the first negative type silver halide emulsion layer (2) or the second negative type silver halide emulsion layer (3) is separated from the spontaneously developable silver salt-containing colloidal layer (1) by an interlayer comprising a hydrophilic colloid.

40. The diffusion transfer film unit as described in claim 39, wherein said interlayer contains a component capable of preventing interlayer migration of an oxidation product of the color developing agent.

41. The diffusion transfer film unit as described in claim 42, wherein said interlayer contains a ballasted dihydroxybenzene.

42. The diffusion transfer unit as described in claim 41, wherein said ballasted dehydroxybenzene is a ballasted hydroquinone.

43. The diffusion transfer film unit as described in claim 33, wherein two of the emulsion layer units are separated from each other by a spacer layer comprising a hydrophilic colloid.

44. The diffusion transfer film unit as described in claim 43, wherein said spacer layer contains a component capable of preventing interlayer migration of an oxidation product of the color developing agent.

45. The diffusion transfer film unit as described in claim 44, wherein said spacer layer contains component capable of preventing migration of a released development inhibitor between emulsion layer units.

46. The diffusion transfer film unit as described in claim 44, wherein said spacer layer contains a ballasted dihydroxybenzene as the component for preventing migration of an oxidation product of the developing agent.

47. The diffusion transfer film unit as described in claim 46, wherein said spacer layer contains a ballasted hydroquinone as the component for preventing migration of an oxidation product of the developing agent.

48. The diffusion transfer film unit as described in claim 45, wherein said spacer layer contains low light-sensitivity silver halide fine particles or metallic silver fine particles.

49. The diffusion transfer film unit as described in claim 33, wherein in at least one of said emulsion layer units, the development inhibitor to the released from the first negative type light-sensitive emulsion layer (2) is a diffusible aryl mercapto compound or a hetero ring mercapto compound.

50. The diffusion transfer film unit as described in claim 33, wherein in at least one of said emulsion layer units, the development inhibitor released from the first negative type light-sensitive emulsion layer (2) is a diffusible benzotriazole compound.

51. The diffusion transfer film unit as described in claim 33, wherein in at least one of said emulsion layer units, the first negative type light-sensitive emulsion layer (2) contains a ballasted color coupler capable of forming a non-diffusible dye, in addition to the development inhibitor-releasing compound, said ballasted compound being present in an amount of not less than about 20 mol % based upon both the ballasted compound to release the diffusible development inhibitor and the ballasted coupler to release non-diffusible dye.

52. The diffusion transfer film unit as described in claim 33, wherein in at least one of said emulsion layer units the ballasted compound in the first negative-type light-sensitive emulsion layer (2) is a development inhibitor-releasing coupler.

53. The diffusion transfer film unit as described in claim 33, wherein in at least one of said emulsion layer units, the ballasted compound in the first negative type light-sensitive emulsion layer (2) is a development inhibitor-releasing hydroquinone.

54. The diffusion transfer film unit as described in claim 52, wherein said development inhibitor-releasing coupler is substituted with an arylthio group, a hetero ring thio group or an N-benzotriazolyl group in the reaction site of the coupler.

55. The diffusion transfer film unit as described in claim 53, wherein said development inhibitor-releasing hydroquinone is nucleus-substituted with a hetero ring thio group.

56. The diffusion transfer film unit as described in claim 33, wherein in at least one of said emulsion layer units, the first negative type light-sensitive emulsion layer (2) contains a development inhibitor-releasing compound comprising about 20 mol % or more of the total components of the layer capable of reacting with an oxidation product of the color developing agent, said total components being the non-diffusible dye-forming couplers and the development inhibitor-releasing compounds.

57. The diffusion transfer film unit as described in claim 33, wherein in at least one of said emulsion layer units, the second negative type light-sensitive emulsion layer (3) contains a development inhibitor-releasing compound comprising about 20 mol % or less of the coupling components within the layer.

58. The diffusion transfer film unit as described in claim 33, wherein at least part of the aromatic primary amine developing agent is contained in said processing solution element.

59. The diffusion transfer film unit as described in claim 33, wherein at least a part of the aromatic primary amine developing agent or a precursor thereof is contained in the light-sensitive element.

60. The diffusion transfer film unit as described in claim 33, wherein said unit contains a developing agent-capturing agent capable of reacting, after the substantial completion of the dye image formation, with the remaining aromatic primary amine color developing agent to form a substantially colorless product.

61. The diffusion transfer film unit as described in claim 33, wherein in at least one of said emulsion layer units, the spontaneously developable silver salt hydrophilic colloidal layer (1) is a silver halide dispersion chemically rendered spontaneously developable.

62. The diffusion transfer film unit as described in claim 61, wherein said silver halide dispersion contains silver halide grains of a mean grain size of about 0.5 to 2 $\mu$ and with about 30% or less in number of the grains having a grain size of about 0.3 $\mu$ or smaller.

63. The diffusion transfer film unit as described in claim 33, wherein in at least one of said emulsion layer units, the hydrophilic colloidal layer (1) contains silver-depositing nuclei and a slightly soluble silver salt as said spontaneously developable silver salt.

64. The diffusion transfer film unit as described in claim 63, wherein said silver-depositing nuclei are a heavy metal fine colloid or a metal sulfide fine colloid and the slightly soluble silver salt is an inorganic silver salt or an organic silver salt.

65. The diffusion transfer film unit as described in claim 64, wherein said heavy metal fine colloid is fine colloidal silver, gold, platinum, or palldium; said metal sulfide fine colloid is fine collodial silver sulfide, gold sulfide, cadmium sulfide or zinc sulfide; said inorganic silver salt is a silver halide, silver thiocyanate or silver phosphate; and said organic silver salt is silver oxalate or silver tartarate.

66. The diffusion transfer film unit as described in claim 33, wherein in at least one of said emulsion layer units, the light sensitivity as a threshold value of the second negative type light-sensitive emulsion layer (3) ranges from about $\frac{2}{3}$ to about 1/10 the sensitivity as a threshold value of the first negative type light-sensitive emulsion layer (2) and both negative type light-sensitive emulsions cooperate with each other to form a negative gradation suitable as an original for color printing.

67. The diffusion transfer film unit as described in claim 33, wherein an surface of the emulsion unit is covered by a removable processing solution-permeable layer having the necessary light-intercepting property to protect the silver halide emulsion layers of the emulsion unit from ambient light while the film unit is processed outside a camera.

68. The diffusion transfer film unit as described in claim 33, wherein the backside of the support opposite the emulsion-coated side of the support of the light-sensitive material is covered by a removable layer having the necessary light-intercepting ability to protect the silver-halide emulsion layers from ambient light while the film unit is processed outside a camera.

69. The diffusion transfer film unit as described in claim 33, wherein said image-receiving element includes a transparent support.

70. The diffusion transfer film unit as described in claim 33, wherein at least one of the light-sensitive element and the image-receiving element includes a neutralizing layer containing a ballasted acidic substance or a precursor thereof, suitably positioned in order that the pH in the film unit is reduced to around neutrality after the substantial completion of the formation of the diffusion transferred images.

* * * * *